US007928945B2

(12) United States Patent
Kimura et al.

(10) Patent No.: US 7,928,945 B2
(45) Date of Patent: Apr. 19, 2011

(54) DISPLAY DEVICE AND DRIVING METHOD THEREOF

(75) Inventors: Hajime Kimura, Atsugi (JP); Keisuke Miyagawa, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 951 days.

(21) Appl. No.: 10/844,491

(22) Filed: May 13, 2004

(65) Prior Publication Data

US 2004/0263440 A1 Dec. 30, 2004

(30) Foreign Application Priority Data

May 16, 2003 (JP) ..... 2003-138781
May 16, 2003 (JP) ..... 2003-138796

(51) Int. Cl.
*G09G 3/36* (2006.01)

(52) U.S. Cl. ..... 345/92; 345/100

(58) Field of Classification Search ..... 345/36, 345/48, 76, 77, 82, 84, 204, 205, 87, 88, 345/89, 92

See application file for complete search history.

(56) References Cited

U.S. PATENT DOCUMENTS 6,246,180 B1 6/2001 Nishigaki
6,525,704 B1 2/2003 Kondo et al.
6,548,960 B2 4/2003 Inukai
6,583,775 B1 * 6/2003 Sekiya et al. ..... 345/76
6,650,044 B1 11/2003 Lowery
6,753,654 B2 6/2004 Koyama
6,753,854 B1 6/2004 Koyama et al.

(Continued)

FOREIGN PATENT DOCUMENTS

EP 1031961 A 8/2000

(Continued)

OTHER PUBLICATIONS

S. Kanbe et al, *Patterning of High Performance Poly(dialkylfluorene) Derivatives for Light-Emitting Full Color Display by Ink-Jet Printing*, Base Technology Research Center, Seiko Epson Corporation, Proc. Euro Display, 1999, pp. 85-88.

(Continued)

*Primary Examiner* — Quan-Zhen Wang
*Assistant Examiner* — Calvin C Ma
(74) *Attorney, Agent, or Firm* — Eric J. Robinson; Robinson Intellectual Property Law Office, P.C.

(57) ABSTRACT

In the respect of an electrical characteristic of a transistor, a channel size W/L of a transistor is preferably designed small in order to decrease an effect of a variation in threshold voltage, while the channel size W/L is preferably designed large in order to widen a saturation region as an operation region of the transistor in the respect of characteristic of a light emitting element. Thus, decreasing an effect of a variation in threshold voltage and widening a saturation region in order not to reduce luminance due to a degradation of the light emitting element are in the relation of trade-off. According to the invention, a current capacity of a driving transistor is increased so as to operate in a wide saturation region. A lighting period control circuit is provided in each pixel for changing a lighting period of each pixel separately. Another configuration of the invention includes a plurality of transistors, for example a first driving transistor and a second driving transistor, and a lighting period control circuit for controlling a lighting period of the light emitting element in each pixel.

8 Claims, 27 Drawing Sheets

U.S. PATENT DOCUMENTS

| | | | | |
|---|---|---|---|---|
| 6,756,740 | B2 | 6/2004 | Inukai | |
| 6,777,710 | B1 | 8/2004 | Koyama | |
| 6,781,153 | B2 | 8/2004 | Anzai | |
| 6,781,567 | B2 | 8/2004 | Kimura | |
| 6,784,454 | B2 | 8/2004 | Anzai | |
| 6,798,405 | B2 | 9/2004 | Anzai | |
| 6,859,193 | B1 | 2/2005 | Yumoto | |
| 6,864,637 | B2 | 3/2005 | Park et al. | |
| 7,006,067 | B2 * | 2/2006 | Tobita et al. | 345/92 |
| 7,049,159 | B2 | 5/2006 | Lowery | |
| 7,061,451 | B2 * | 6/2006 | Kimura | 345/76 |
| 7,091,938 | B2 | 8/2006 | Inukai et al. | |
| 7,123,233 | B2 | 10/2006 | Senda | |
| 7,138,967 | B2 | 11/2006 | Kimura | |
| 7,154,455 | B2 | 12/2006 | Matsumoto | |
| 7,193,591 | B2 | 3/2007 | Yumoto | |
| 7,233,342 | B1 | 6/2007 | Yamazaki et al. | |
| 7,336,035 | B2 | 2/2008 | Koyama | |
| 7,336,251 | B2 | 2/2008 | Osada | |
| 7,379,039 | B2 | 5/2008 | Yumoto | |
| 7,388,564 | B2 | 6/2008 | Yumoto | |
| 7,463,251 | B2 | 12/2008 | Giraldo et al. | |
| 2002/0074580 | A1 | 6/2002 | Anzai et al. | |
| 2002/0075254 | A1 | 6/2002 | Anzai | |
| 2002/0084746 | A1 | 7/2002 | Anzai | |
| 2002/0101394 | A1 | 8/2002 | Anzai | |
| 2003/0011314 | A1 * | 1/2003 | Numao | 315/169.3 |
| 2003/0011584 | A1 * | 1/2003 | Azami et al. | 345/204 |
| 2003/0090481 | A1 | 5/2003 | Kimura | |
| 2003/0160745 | A1 | 8/2003 | Osame et al. | |
| 2004/0164303 | A1 | 8/2004 | Anzai | |
| 2004/0252085 | A1 | 12/2004 | Miyagawa | |
| 2005/0002260 | A1 | 1/2005 | Koyama | |
| 2005/0140609 | A1 * | 6/2005 | Akimoto et al. | 345/76 |
| 2005/0264492 | A1 | 12/2005 | Knapp et al. | |
| 2006/0071879 | A1 | 4/2006 | Giraldo et al. | |
| 2006/0097965 | A1 | 5/2006 | Deane et al. | |
| 2007/0052635 | A1 | 3/2007 | Kimura | |
| 2008/0197777 | A1 | 8/2008 | Koyama | |

FOREIGN PATENT DOCUMENTS

| | | | |
|---|---|---|---|
| EP | 1061497 | A | 12/2000 |
| EP | 1111574 | A | 6/2001 |
| EP | 1130565 | A | 9/2001 |
| EP | 1 193 676 | | 4/2002 |
| EP | 1193678 | | 4/2002 |
| EP | 1198016 | | 4/2002 |
| EP | 1249823 | | 10/2002 |
| EP | 1 310 937 | | 5/2003 |
| JP | 08-129358 | A | 5/1996 |
| JP | 08-129359 | | 5/1996 |
| JP | 2000-221942 | A | 8/2000 |
| JP | 2000-284751 | | 10/2000 |
| JP | 2000-310980 | A | 11/2000 |
| JP | 2000-347621 | A | 12/2000 |
| JP | 2001-034231 | | 2/2001 |
| JP | 2001-042822 | A | 2/2001 |
| JP | 2001-060076 | A | 3/2001 |
| JP | 2001-109421 | A | 4/2001 |
| JP | 2001-142427 | A | 5/2001 |
| JP | 2001-242827 | A | 9/2001 |
| JP | 2002-175048 | | 6/2002 |
| JP | 2002-185048 | | 6/2002 |
| JP | 2002-251166 | A | 9/2002 |
| JP | 2002-304147 | A | 10/2002 |
| JP | 2002-333862 | A | 11/2002 |
| JP | 2002-358049 | A | 12/2002 |
| JP | 2002-372703 | | 12/2002 |
| JP | 2003-022050 | A | 1/2003 |
| JP | 2003-099000 | A | 4/2003 |
| JP | 2003-108071 | | 4/2003 |
| JP | 2003-216110 | | 7/2003 |
| JP | 2003-280557 | A | 10/2003 |
| JP | 2004-094211 | A | 3/2004 |
| JP | 2004-109991 | A | 4/2004 |
| JP | 2004-205856 | A | 7/2004 |
| JP | 2005-538402 | | 12/2005 |
| JP | 2006-509233 | | 3/2006 |
| JP | 2006-518473 | | 8/2006 |
| JP | 2006-523322 | | 10/2006 |
| WO | WO-01/06484 | | 1/2001 |
| WO | WO-03/027997 | | 4/2003 |
| WO | WO 2004/023446 | | 3/2004 |
| WO | WO-2004/051617 | | 6/2004 |
| WO | WO-2004/066250 | | 8/2004 |
| WO | WO-2004/088625 | | 10/2004 |

OTHER PUBLICATIONS

M. Mizukami et al., *6-Bit Digital VGA OLED*, SID 00 Digest, 2000, pp. 912- 915.

K. Inukai et al., *Late-News Paper: 4.0-in. TFT-OLED Displays and a Novel Digital Driving Method*, SID 00 Digest, 2000, pp. 924-927.

S. Miyashita et al., *Full Color Displays Fabricated by Ink-Jet Printing*, Asia Display/IDW '01, 2001, pp. 1399-1402.

R.M.A. Dawson et al., *Design of an Improved Pixel for a Polysilicon Active-Matrix Organic LED Display*, SID 98 Digest, 1998, pp. 11-14.

T. Sasaoka et al., *Late-News Paper: A 13.0-inch AM-OLED Display with Top Emitting Structure and Adaptive Current Mode Programmed Pixel Circuit (TAC)*, SID 01 Digest, 2001, pp. 384-387.

A. Yumoto et al., *Pixel-Driving Methods for Large-Sized Poly-Si AM-OLED Displays*, Asia Display/IDW '01, 2001, pp. 1395-1398.

R. Hattori et al., *Current-Writing Active-Matrix Circuit for Organic Light-Emitting Diode Display Using a-Si:H Thin-Film-Transistors*, IEICE Transactions on Electronics, vol. E83-C, No. 5, May, 2000, pp. 779-782.

Y. He et al., *Current-Source a-Si:H Thin-Film Transistor Circuit for Active-Matrix Organic Light-Emitting Displays*, IEEE Electron Device Letters, vol. 21, No. 12, Dec. 2000, pp. 590-592.

R.M.A. Dawson et al., *The Impact of the Transient Response of Organic Light Emitting Diodes on the Design of Active Matrix OLED Displays*, IEDM 98, 1998, pp. 875-878.

M.T. Johnson, et al. *Active Matrix PolyLED Displays*, IDW '00, 2000, pp. 235-238.

M. Mizukami et al., *6-Bit Digital VGA OLED*, SID 00 Digest, 2000, vol. 31, pp. 912-915.

* cited by examiner

DISPLAY DEVICE AND DRIVING METHOD THEREOF

BACKGROUND OF THE INVENTION

1. Field of the Invention

The invention relates to a display device including a self-luminous light emitting element and a driving method thereof. More specifically, the invention relates to a pixel arrangement of the display device.

2. Description of the Related Art

In recent years, a display device having a light emitting element (self-luminous element) is actively developed. Such a display device is widely used as a display of a portable phone and a monitor of a computer by taking advantage of high resolution, thinness, and lightweight. In particular, such a display device has features as fast response, low voltage, low power consumption and the like, therefore it is expected to be applied to a wide range of devices including a new generation of a portable phone and a portable information terminal (PDA).

A light emitting element is also referred to as an organic light emitting diode (OLED) and has a structure that includes an anode, a cathode, and a layer including an organic compound (hereinafter referred to as an organic compound layer) sandwiched between the anode and cathode. A current flowing into the light emitting element and a luminance thereof have a fixed relation between them. The light emitting element emits light in accordance with a current flowing to the organic compound layer.

As a driving method of a display device having a light emitting element for displaying an image of multilevel gray scale, there are an analog driving method (analog gray scale method) and a digital driving method (digital gray scale method). They are different in the respect of a method for controlling emission and non-emission of a light emitting element.

In the analog driving method, a current flowing to the light emitting element is continuously controlled to display a gray scale. In the digital driving method, the light emitting element is controlled to be either ON state (a luminance is almost 100%) or OFF state (a luminance is almost 0%).

In the digital driving method, however, only two gray levels can be displayed as described above. Therefore, a driving method for displaying a multilevel gray scale image in combination with a time gray scale method or an area gray scale method is suggested. In the time gray scale display, for example, one frame is divided into subframes and a length of a light emitting period of each subframe is selectively determined to display a gray scale. Further, in the area gray scale method, a subpixel is provided in a pixel and its light emitting area is selectively determined to display a gray scale.

In the case of inputting a signal into a pixel, a voltage input method is typically employed. In the voltage input method, a luminance of a light emitting element is controlled by inputting a voltage to a gate electrode of a driving element as a video signal to be inputted to a pixel.

A driving method and a multilevel gray scale display method and the like of a display device as described above can be referred in Non-patent Document 1.

[Non-patent Document 1]

"Material technology and fabrication of elements regarding an organic EL display", Technical Information Institute, 2002 January, p.179-196

SUMMARY OF THE INVENTION

In the voltage input method as described above, luminance of light emitting elements vary when current characteristics of transistors for driving (supplying a current to) the light emitting elements vary (hereinafter referred to as driving transistors). In a low gray scale display by the analog gray scale method, in particular, an effect of a variation in electrical characteristics of the driving transistors is large. This is because the current characteristic of a transistor is dependent on (Vgs−Vth). Therefore, as Vgs of the driving transistors is small in the case of displaying a low gray scale, Vth of the driving transistors can easily affect Vgs of the driving transistors. Vth of a transistor is a threshold voltage which varies according to fabrication process such as a deposition condition or film thickness. In a semiconductor element including a polycrystalline silicon film which is formed through a crystallization process in particular, Vth varies because of a grain boundary or an orientation thereof.

The aforementioned problem is described specifically with reference to a transistor and a light emitting element shown in FIG. 11A. FIG. 11B shows Ids-Vds characteristics of the light emitting element and the transistor in the case of a low gray scale display and intersections thereof correspond to operation points. In the case of a low gray scale display as shown in FIG. 11B, a current (Ids) to be supplied from the transistor to the light emitting element is small, and Vgs is low as well. Therefore, it is easily affected by a variation in Vth relatively. As a result, a luminance of a display device including the transistor and the light emitting element varies, leading to a quality degradation thereof. In order not to be easily affected by the threshold voltage as described above, a channel size W/L of a transistor is preferably designed small so that high Vgs of the driving transistors is applied for operation.

The transistor operates in a saturation region so as to flow a constant current to the light emitting element even when V-I characteristics of the light emitting element changes. As shown in FIG. 11C, a saturation region is a region which satisfies Vds>(Vgs−Vth), and Ids does not fluctuate even when a voltage between a source and drain of the transistor changes. Therefore, a constant current can be supplied to the light emitting element at all times.

In the case of a high gray scale display, however, a saturation region of the transistor is narrow. FIG. 11C shows Ids-Vds characteristics of a transistor and a light emitting element in a high gray scale display. As shown in FIG. 11C, a characteristic of a light emitting element shifts to a low voltage side according to a degradation of the light emitting element and Vds is lowered at the same time. As a result, a saturation region in which the transistor operates is narrowed and the transistor may operate in a linear region.

In order to solve such problem in a high gray scale display, it is preferable that a saturation region be wider. For example, it is suggested that a voltage between $\alpha$ and $\beta$ shown in FIG. 11A be increased. As a result, the transistor can operate in a saturation region even when the light emitting element is degraded. In this case, however, power consumption is increased since a voltage becomes high. Alternatively, it is suggested that a channel size W/L of the transistor is formed large so as to lower Vgs.

As described above, a channel size W/L of the transistor is preferably designed small and Vgs of the driving transistors is increased in order to make an effect of a variation in a threshold voltage small in terms of an electric characteristic of the transistor. Meanwhile, a channel size W/L is preferably designed large and Vgs of the driving transistors is decreased in order to widen a saturation region in terms of a characteristic of the light emitting element. Thus, decreasing an effect of a variation in threshold voltage and widening a saturation region in order not to reduce luminance due to a degradation of the light emitting element are in the relation of trade-off.

The invention provides a display device including a semiconductor element including a polycrystalline silicon film or an amorphous silicon film, in which a driving transistor operates in a saturation region in both high and low gray scale displays and a variation in threshold voltages of the driving transistors is decreased, and a driving method thereof.

In view of the aforementioned problems, a current capacity of a driving transistor is enhanced so as to operate in a wide saturation region. As a result, Vgs of the driving transistor can be prevented from being high even in the high gray scale display, thus a saturation region in which the transistor operates can be maintained wide. Further, a circuit for controlling a lighting period (a lighting period control circuit) separately is provided in each pixel. In displaying the low gray scale by using the lighting period control circuit, a lighting period of a light emitting element is controlled to be short (the lighting period is also referred to as an emission period). It should be noted that the lighting period control circuit is disposed so that the light emitting element can be controlled not to emit light in a predetermined period. As a result, a low gray scale display can be performed with high Vgs of the driving transistor, which decreases an effect of a variation in threshold voltage of the driving transistor.

According to the invention, a saturation region of a driving transistor can be wide in the high gray scale display and an effect of a variation in Vth of the driving transistor can be small in the low gray scale display. It is a feature of the invention that W/L of a driving transistor is designed and a lighting period of each pixel is changed according to the levels of gray scale.

Specifically, it is preferable that W/L be large, for example, length of L is tens to hundreds of μm in order to operate in a saturation region. That is, it is preferable that a current capacity of the driving transistor be enhanced. Alternatively, a crystallinity of the driving transistor may be enhanced, by using a continuous oscillation laser, for example.

A plurality of driving transistors may be disposed in parallel in the invention.

As described above, W/L of a driving transistor can be designed so as to keep a saturation region in which the transistor operates wide. As a result, a saturation region in which a transistor operates can be wide and an accurate display can be realized which is not easily affected by a variation in threshold voltage of the driving transistor even in a low gray scale display by using a lighting period control circuit.

According to another structure of the invention, a display device including a lighting period control circuit for controlling a lighting period of a light emitting element is provided. The lighting period control circuit comprises a plurality of driving transistors, for example a first driving transistor and a second driving transistor in each pixel.

The number of driving transistors may be arbitrarily determined. In the case of providing two driving transistors as described above, a current capacity of the first driving transistor is set higher than that of the second driving transistor. For example, channel size W/L (hereinafter referred to simply as W/L) of the first driving transistor is designed large. Otherwise, W/L of the second driving transistor may be designed small since the current capacity of the second driving transistor is not required to be as high as that of the first driving transistor.

Specifically, W/L of the first driving transistor can be designed larger than that of the second driving transistor. For example, it is preferable that length of L of the first transistor be tens to hundreds of μm in order to operate in a saturation region. That is, by using a second driving transistor with small W/L in the low gray scale display, Vgs of the driving transistor can be higher and an effect of a variation in Vth of driving transistors can be decreased. It is also preferable that crystallinity of driving transistors be enhanced, by using a continuous oscillation laser, for example. Therefore, a saturation region can be wide in a high gray scale display only by using the first driving transistor. On the other hand, Vgs of the driving transistor can be high in a low gray scale display by using a lighting period control circuit. As a result, an effect of a variation in Vth of the driving transistor can be decreased.

The lighting period control circuit of the invention having the aforementioned configuration may be disposed so that a light emitting element can be controlled not to emit light at least in the low gray scale display. Further, it may also be disposed so that the light emitting element is controlled not to emit light in the high gray scale display.

By using such first driving transistor, a large current can be supplied even with low Vgs of the driving transistor and an operation in a saturation region can be maintained even when Vds of the driving transistor is lowered. Accordingly, a luminance of a light emitting element is not decreased due to the degradation, and low power consumption and low heat generation can be realized since the first driving transistor can be driven at a low voltage. The second driving transistor can supply current when high Vgs of the driving transistor is applied, thus an effect of a variation of an electric characteristic of a transistor can be decreased. In particular, these transistors are effective for enhancing an image quality in a low gray scale display in which Vgs of the driving transistor is lowered. This is because Vgs of the driving transistor can be high and a variation in Vth of the driving transistor can be decreased by using a lighting period control circuit.

According to the invention as described above, a transistor may be a polycrystalline silicon thin film transistor, an amorphous silicon thin film transistor, or other transistors. That is to say, according to the resent invention, unevenness of display due to a variation in Vth of driving transistors can be decreased.

According to the invention, in the case of using amorphous silicon thin film transistors, all of them are preferably n-channel transistors. Thus, in the case of using only one polarity of transistors, a bootstrap circuit and the like may be employed, which can be referred in Japanese Patent Application No. 2002-327498.

It should be noted that the invention can be applied to a light emitting device of both a top emission structure and a bottom emission structure. Further, the invention can be applied to a light emitting device of a dual emission structure in which a light is emitted from both top and bottom. Thus, a structure of a light emitting device is not limited in the invention. However, the light emitting device of a top emission structure is more preferred when the number of wirings and transistors is increased.

According to the invention, at least W/L of a driving transistor can be designed so that a saturation region in which the driving transistor operates can be wide. As a result, a wide saturation region in which a driving transistor operates can be obtained and an accurate display can be performed even in a low gray scale display.

A display device of the invention includes a first driving transistor, a second driving transistor and a lighting period control circuit in each pixel. W/L of the first driving transistor is designed to be larger than that of the second driving transistor, therefore, Vgs can be higher by using the second driving transistor with small W/L in a low gray scale display. As a result, an effect of a variation in Vth of driving transistor can be decreased and an accurate display can be performed. In particular, it is more preferable to provide a plurality of lighting period control circuits to obtain a further higher Vgs of the driving transistor.

DETAILED DESCRIPTION OF THE INVENTION

These and other objects, features and advantages of the present invention will become more apparent upon reading of the following detailed description along with the accompanied drawings. Although the present invention is fully described by way of example with reference to the accompanying drawings, it is to be understood that various changes and modifications will be apparent to those skilled in the art. Therefore, unless otherwise such changes and modifications depart from the scope of the present invention, they should be construed as being included therein. Note that like components are denoted by like numerals in all the drawings for describing the invention and a description will not be repeated.

Embodiment Mode1

In this embodiment mode, a pixel configuration in which an analog signal, in particular an analog voltage is inputted as a video signal is described.

Figure 1A:
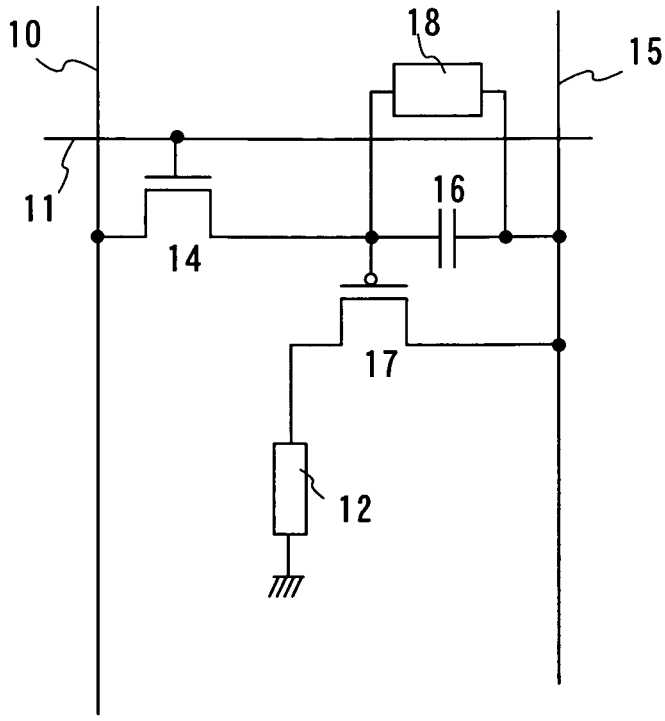
FIGS. 1A and 1B are diagrams showing pixel configurations of the display device of the invention.
Figure 1B:
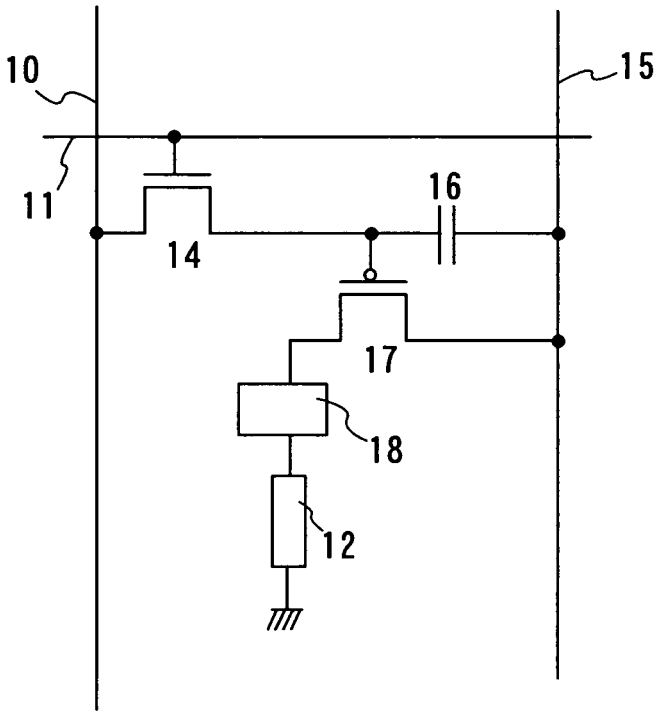

FIGS. 1A and 1B show active matrix pixel configurations, including a signal line 10, a scan line 11, and a light emitting element 12. An n-channel switching transistor Tr 14 is connected to the signal line 10 and the scan line 11. Note that, in the present invention, a connection intends to an electrically connection. When the switching transistor Tr 14 is selected by the scan line 11 and turned ON, an analog voltage is applied from the signal line 10 so as to obtain a desirable luminance. A capacitor Cs 16 disposed between the switching transistor Tr 14 and a power supply line 15 stores a charge in accordance with the inputted analog voltage. The capacitor Cs 16 stores a voltage between a gate and source of a p-channel driving transistor Tr 17. When the driving transistor Tr 17 is turned ON, a current according to the charge stored in the Cs 16 is supplied to the light emitting element 12 to emit light at a predetermined luminance.

At this time, W/L of the driving transistor Tr 17 is set so that a wide saturation region can be obtained. Accordingly, it can be prevented that the driving transistor Tr 17 operates in a linear region even when the light emitting element 12 is degraded over time.

In displaying a low gray scale with such a pixel configuration, a lighting period of a light emitting element is controlled to be short by using a lighting period control circuit 18. That is, the lighting period control circuit 18 has a circuit configuration for controlling a lighting period (also referred to as a light emitting period) of the light emitting element. By using the lighting period control circuit, a charge stored in the Cs 16 is released at a predetermined timing not to flow a current to the driving transistor Tr 17, thus a lighting period of the light emitting element is controlled. The lighting period control circuit may be disposed at any place as long as it can control a lighting period of a light emitting element. It is connected to each end of the Cs 16 in FIG. 1A. The lighting period control circuit is provided in each pixel in the invention, therefore, a charge stored in the Cs 16 can be released per pixel. It should be noted that a period in which a light emitting element is put into a non-emission state by the lighting period control circuit is referred to as an erasing operation period.

Accordingly, in the case of designing W/L of a driving transistor so as to obtain as wide saturation region as possible, a low gray scale display can be performed while preventing |Vgs| of the driving transistor Tr 17 from being low by controlling a current supply to a light emitting element by providing an erasing operation period.

Therefore, a low gray scale display can be performed accurately when W/L of a driving transistor is designed so as to obtain a wide saturation region. Moreover, a wide saturation region in which a driving transistor operates can be obtained in the case of the high gray scale display.

According to the invention, the lighting period control circuit may be disposed so that it can control a period for supplying a predetermined current to the light emitting element. For example, it may be disposed between the light emitting element and the driving transistor Tr 17 as shown in FIG. 1B.

When disposing the lighting period control circuit as shown in FIG. 1B, an erasing operation period can be provided regardless of a characteristic of the driving transistor Tr 17, in particular a threshold voltage Vth thereof. That is, in the case where the driving transistor Tr 17 is a normally-on transistor in which a current flows when a voltage is zero, the erasing operation period can be provided without fail since a connection between the light emitting element and the driving transistor Tr 17 is short-circuited by the lighting period control circuit, thus a low gray scale display can be performed.

It should be noted that the description is made on the case of using a p-channel driving transistor, however, an n-channel driving transistor may be used as well. A fabrication process can be simplified by using only either n-channel transistors or p-channel transistors.

As described above, a low gray scale display can be performed accurately by providing a lighting period control circuit in each pixel, even in the case of designing W/L of a driving transistor so that a saturation region can be wide. A structure or a polarity of a transistor in the lighting period control circuit or a pixel, and a pixel configuration or an arrangement of the lighting period control circuit are not limited to FIGS. 1A and 1B.

Embodiment Mode 2

In this embodiment mode, a specific example of a pixel configuration in which a lighting period control circuit is disposed at each end of the capacitor as shown in FIG. 1A is described with reference to FIGS. 2A and 2B.

Figure 2A:
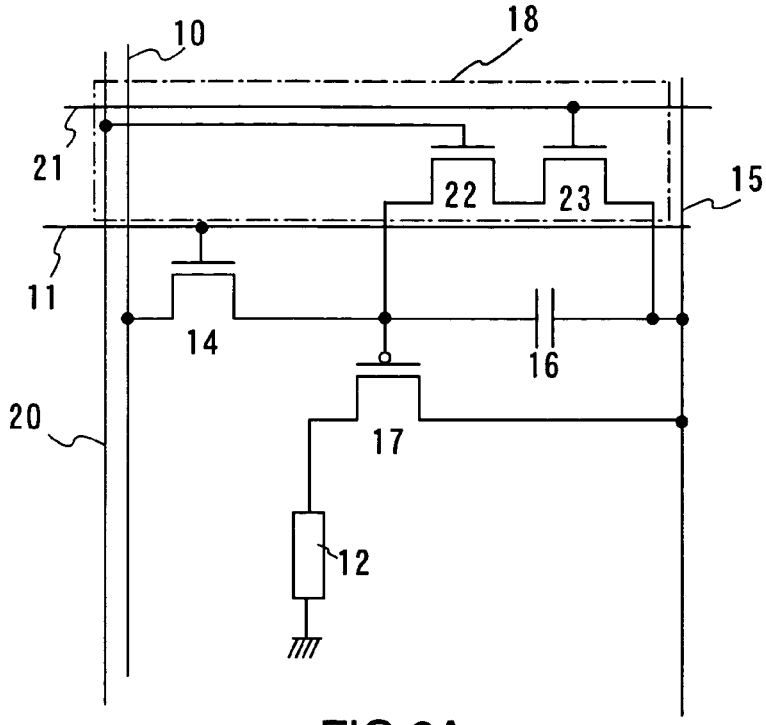
FIGS. 2A and 2B are diagrams showing pixel configurations of the display device of the invention.

A pixel shown in FIG. 2A includes a switching transistor Tr 14 connected to a signal line 10 and a scan line 11, a capacitor Cs 16 disposed between the switching transistor Tr 14 and a power supply line 15, the driving transistor Tr 17 of which gate electrode is connected to the switching transistor Tr 14 and the capacitor Cs 16, and a light emitting element 12 connected to the driving transistor Tr 17. A lighting period control circuit 18 including transistors 22 and 23 connected in series is provided at each end of the capacitor Cs 16, a gate electrode of the transistor Tr 22 is connected to an erasing signal line 20, and a gate electrode of the transistor Tr 23 is connected to an erasing scan line 21. It should be noted in this embodiment that the transistors Tr 14, Tr 22, and Tr 23 are n-channel transistors, while the driving transistor Tr 17 is a p-channel transistor.

Operation of the aforementioned pixel configuration is described now. When the transistor Tr 14 is selected by the scan line 11 and turned ON, an analog voltage according to each gray scale is inputted from the signal line 10. A charge is stored in the capacitor Cs 16 based on the inputted analog voltage, and a predetermined current flows to the light emitting element 12 to emit light when the driving transistor Tr 17 is turned ON.

In the case of a low gray scale display, the charge stored in the capacitor Cs 16 is released after the predetermined period to put the light emitting element 12 into a non-emission state. Specifically, the transistors Tr 22 and Tr 23 are controlled to be both ON to perform a low gray scale display. At this time, an analog voltage inputted from the signal line has a value according to a lighting period.

Operations of the transistors Tr 22 and Tr 23 are described now. When putting the light emitting element 12 into a non-emission state, the erasing scan line 21 is selected and the transistor Tr 23 in each pixel connected to the erasing scan line in the same column is turned ON. At this time, an erasing signal is inputted from the erasing signal line 20. Specifically, a High signal is inputted to the transistor Tr 22 of a pixel for displaying low gray scale and the transistor Tr 22 is turned ON. That is to say, the transistors Tr 22 and Tr 23 are both turned ON and a charge stored in the capacitor Cs 16 is released. As a result, the light emitting element 12 is put into a non-emission state and a low gray scale display can be performed. That is, only a pixel in which the transistors Tr 22 and Tr 23 are both turned ON can be in a non-emission state. Thus, a lighting period can be controlled per pixel.

Pixels are arranged in matrix actually, and the scan lines are selected sequentially to input analog voltage. Therefore, a timing at which the erasing scan line 21 is selected is later than a timing at which the scan line 11 is selected. Note that the timing at which the erasing scan line 21 is selected can be determined by the practitioner according to the length of the lighting period.

Figure 2B:
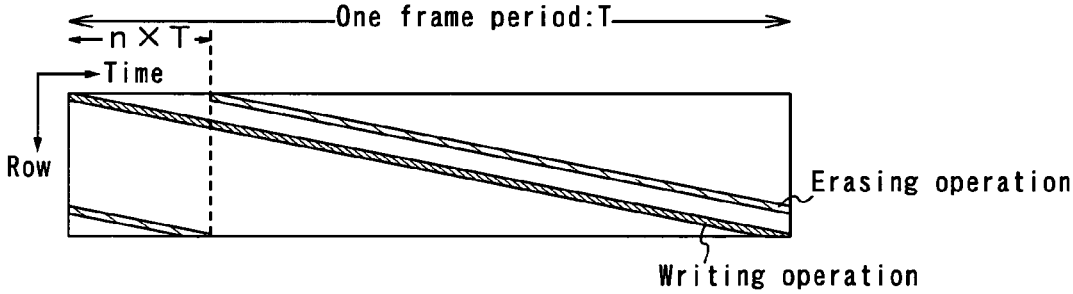

FIG. 2B is a timing chart in which the erasing scan line is selected at a timing after n×T ($0<n<1$). As time passes, a scan line in each row is sequentially selected and the transistors Tr 14 are turned ON per column, and an analog voltage is applied from the signal line 10. Thereafter, a charge according to the analog voltage is stored in the capacitor Cs 16*a* and the driving transistor Tr 17 is turned ON. Then, the light emitting element 12 starts emitting light at a luminance according to each analog voltage.

Each erasing scan line in each row is sequentially selected after n×T and the transistors Tr 23 are turned ON per column. However, a pixel in which an erasing operation is actually performed, that is for performing a low gray scale display, varies in each column. Therefore, an erasing signal is inputted via the erasing signal line 20 only to the transistor Tr 22 in a pixel for a low gray scale display. As a specific erasing signal, a High signal is inputted from the erasing signal line 20, which turns ON the n-channel transistor Tr 22. That is to say, the light emitting element 12 in the pixel which is inputted an erasing signal from the erasing signal line 20 is put into a non-emission state in synchronization with the timing at which the erasing scan line 21 is selected, thus the low gray scale display is performed.

A low gray scale display and a timing at which a scan line and an erasing scan line are selected and the like are described by specifying the number of gray scale levels.

In the case of displaying 64-level gray scale, for example, a scan line is selected in one frame period T and analog voltage of each gray scale is inputted from a signal line to a pixel. Then, in a low gray scale from the first to eighth gray scale, a lighting period is set short.

When an erasing operation starts after (⅛) T from writing operation, an erasing scan line is selected (⅛) T after the scan line is selected. For example, in the case of displaying gray scale of two levels, a video signal corresponding to two divided by (⅛)=16 levels of gray scale is inputted. Then, as a lighting period is (⅛) T, gray scale of two levels is displayed actually. Similarly, in the case of displaying gray scale of eight levels, a video signal corresponding to eight divided by (⅛)=64 levels of gray scale is inputted. Then, as a lighting period is (⅛) T, gray scale of eight levels is displayed actually. In the case of displaying gray scale of nine levels or more, a video signal is inputted which corresponds to the gray scale as it is. At this time, as a lighting period is T, a gray scale is displayed as it is.

A low gray scale display is preferably of 64/N levels or less in the case where a gray scale display of 64 levels is performed and an erasing operation period starts after (1/N) T as in this embodiment mode, though it can be determined appropriately by a practitioner It is needless to say that a display can be performed even in the case of displaying gray scale of 64/N levels or more by shortening a lighting period by a lighting period control circuit. In the case of gray scale display of nine levels, however, an analog voltage of gray scale of 72 levels (9 gray scale×8) is required to be inputted, which is not preferable since it is more than 64-level gray scale.

That is to say, a region of a low gray scale display is preferably set considering a timing of an erasing operation (length of lighting period) so as not to exceed a maximum level of gray scale which is determined by a specification of a display device.

Figure 15:
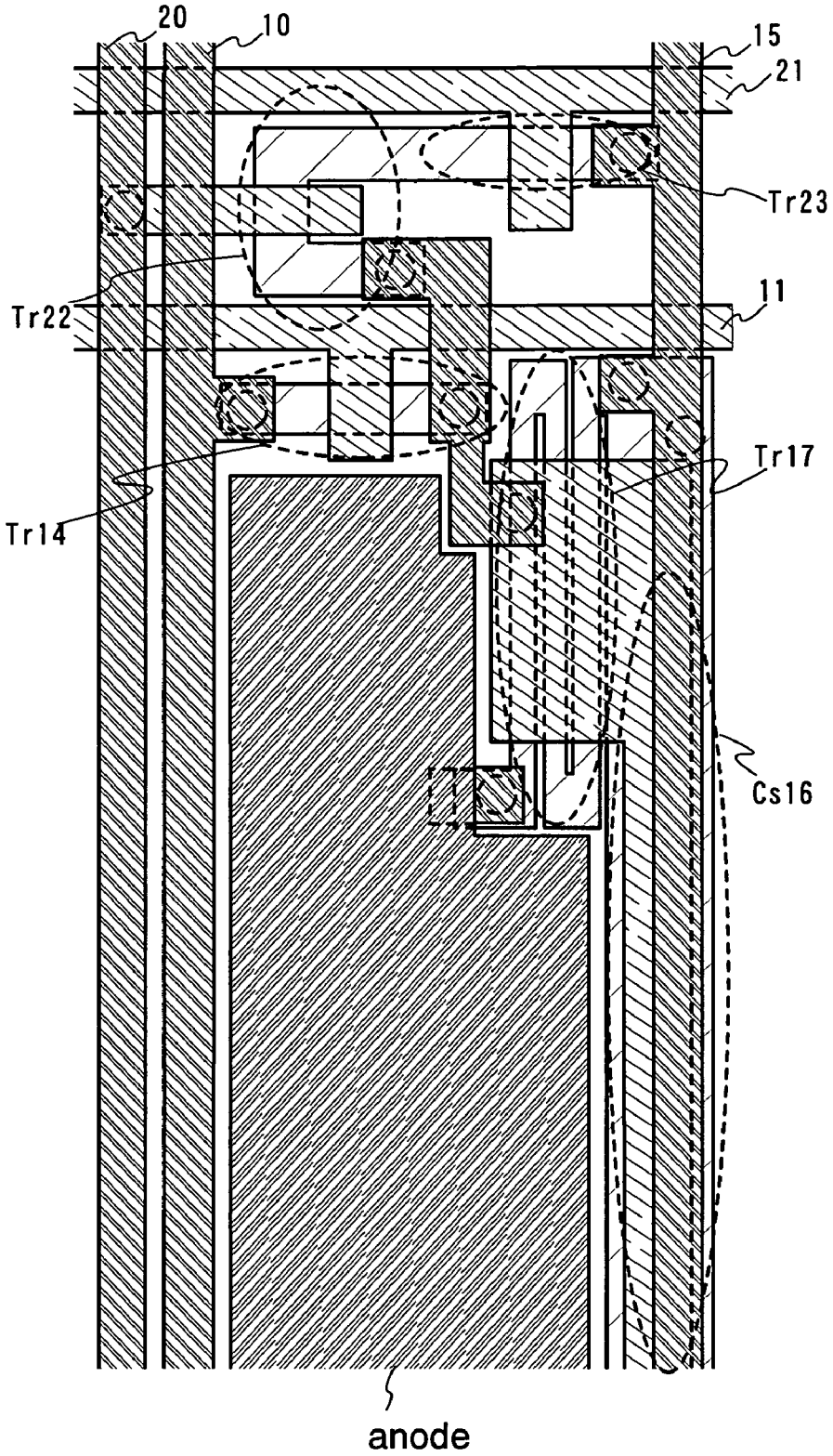
FIG. 15 is a top plan view of a pixel configuration of a display device of the invention.

FIG. 15 shows an example of a top plan view of a pixel corresponding to the circuit diagrams of FIGS. 2A and 2B. The driving transistor Tr 17 may be formed so that W/L thereof becomes large. In order to operate the driving transistor Tr 17 in a saturation region, it is preferable that length of L is tens to hundreds of μm and length of W is a few μm. For this reason, a semiconductor film is formed in a rectangle shape and a gate metal occupies a large area.

In the case of performing a low gray scale display by using the driving transistor Tr 17, a lighting period can be shortened by using a lighting period control circuit. Thus, an accurate gray scale can be displayed in which an affect of a variation in Vth of driving transistors is decreased.

By designing W/L of a driving transistor so that a saturation region can be wide in this manner, a low gray scale display can be performed by providing a lighting period control circuit even in the case where Vgs is high. That is to say, according to the invention, an effect of a variation in threshold voltage of driving transistors can be decreased while a saturation region as an operation region can be wide for preventing a luminance decay due to a degradation of a light emitting element.

Embodiment Mode 3

In this embodiment mode, an example in which a lighting period control circuit is disposed at each end of a capacitor as shown in FIG. 1A and a length of a lighting period is further increased than Embodiment Mode 2 is described with reference to FIGS. 3A and 3B.

Figure 3A:
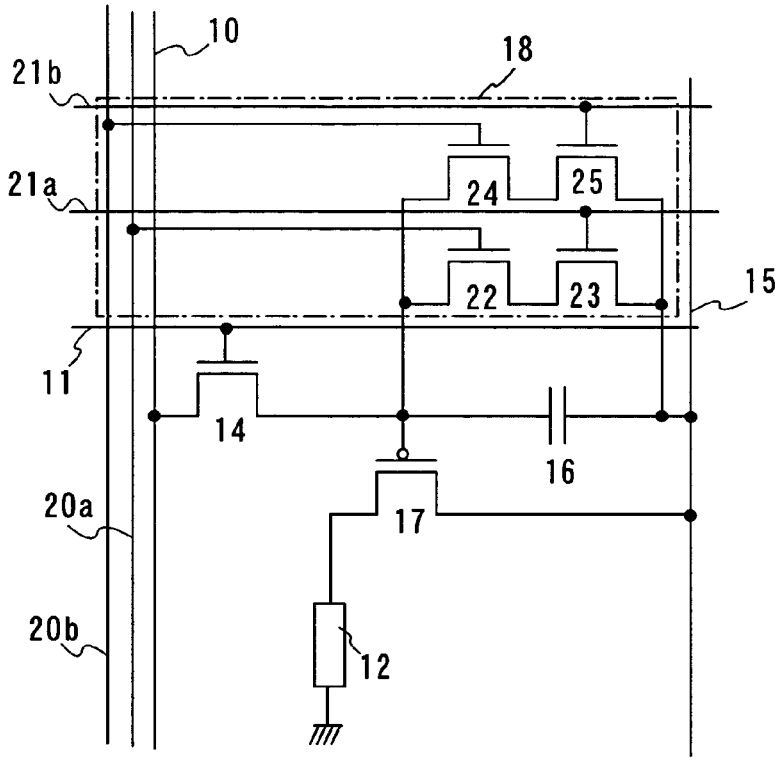
FIGS. 3A and 3B are diagrams showing pixel configurations of the display device of the invention.

A pixel shown in FIG. 3A includes a switching transistor Tr 14 connected to a signal line 10 and a scan line 11, a capacitor Cs 16 disposed between the switching transistor Tr 14 and a power supply line 15, the driving transistor Tr 17 of which gate electrode is connected to the switching transistor Tr 14 and the capacitor Cs 16, and a light emitting element 12 connected to the driving transistor Tr 17. There are four transistors, Tr 22, Tr 23, Tr 24, and Tr 25 in a lighting period control circuit 18 shown in FIG. 3A. Gate electrodes of the transistors Tr 22 and Tr 24 are connected to first and second erasing signal lines 20*a* and 20*b* respectively. Gate electrodes of the transistors Tr 23 and Tr 25 are connected to first and second erasing scan lines 21*a* and 21*b* respectively. It should be noted in this embodiment mode that the transistors Tr 22, Tr 23, Tr 24, and Tr 25 are all n-channel transistors.

Figure 3B:
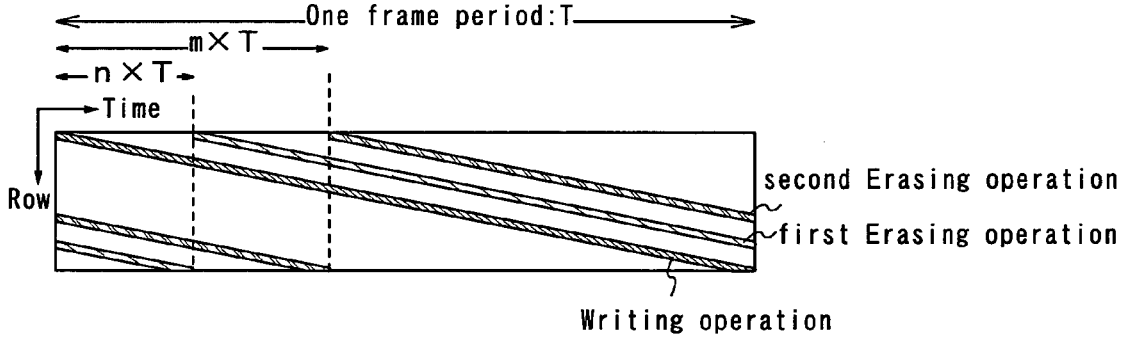

In this manner, in the case of providing two erasing scan lines and two erasing signal lines, there is a case where a lighting period is n×T and a case where a lighting period is m×T, as shown in FIG. 3B. That is to say, a first erasing operation starts after n×T and a second erasing operation starts after m×T. In short, there length of are three lighting periods of T, n×T, and m×T.

A description is made with the specific number of gray scale levels as an example. In the case of displaying gray scale of two levels, a video signal corresponding to two divided by (⅛)=16 levels of gray scale is inputted. At this time, as a lighting period is (⅛) T, gray scale of two levels is displayed actually. Similarly, in the case of displaying gray scale of eight levels, a video signal corresponding to eight divided by (⅛)=64 levels of gray scale is inputted. As a lighting period is (⅛) T, gray scale of eight levels is displayed actually. In the case of displaying gray scale of nine levels, a video signal corresponding to nine divided by (¼)=36 levels of gray scale is inputted. At this time, as a lighting period is (¼) T, 9 levels of gray scale is displayed actually. Similarly, in the case of displaying gray scale of 16 levels, a video signal corresponding to 16 divided by (¼)=64 levels of gray scale is inputted. As a lighting period is (¼) T, gray scale of 16 levels is displayed actually. In the case of displaying a gray scale of 17 levels or more, a video signal is inputted which corresponds to the gray scale as it is. At this time, as a lighting period is T, a gray scale is displayed as it is.

According to the invention, a plurality of erasing operation periods can be provided according to a transistor connected to each of an erasing scan line and an erasing signal line respectively. A timing, number and the like of an erasing operation can be determined by a practitioner appropriately.

An aperture ratio might be decreased in accordance with the increased number of wirings and transistors. However, by adjusting the arrangement of wirings and transistors or employing a top emission method in which a light emitting element emits light in the direction opposite to the transistors, an aperture ratio can be prevented from decreasing. The top emission method can be applied to any pixel configurations of the invention.

Embodiment Mode 4

In this embodiment mode, a specific example of a circuit configuration which has a lighting period control circuit at each end of a capacitor as shown in FIG. 1A and different from Embodiment Modes 2 and 3 is described with reference to FIG. 4.

A pixel shown in FIG. 3A includes a switching transistor Tr 14 connected to a signal line 10 and a scan line 11, a capacitor Cs 16 disposed between the switching transistor Tr 14 and a power supply line 15, the driving transistor Tr 17 of which gate electrode is connected to the switching transistor Tr 14 and the capacitor Cs 16, and a light emitting element 12 connected to the driving transistor Tr 17. As shown in FIG. 4, a lighting period control circuit 18 includes a transistor Tr 26 connected to the erasing signal line 20, the transistor Tr 22 of which gate electrode is connected to a drain electrode of the transistor Tr 26, the transistor Tr 23 of which gate electrode is connected to the erasing scan line 21 and connected to the transistor Tr 22 in series, and an erasing capacitor Cs 27 provided between a gate electrode of the transistor Tr 22 and a power supply line 15. It should be noted in this embodiment mode that the transistors Tr 22, Tr 23, and Tr 26 are all n-channel transistors.

Operation of the aforementioned pixel configuration is described now. The transistors Tr 14 and Tr 26 are selected by the scan line 11 at the same time and an analog voltage and an erasing signal are inputted from the signal line 10 and the erasing signal line 20 respectively. At this time, a charge is stored in the erasing capacitor Cs 27 according to the inputted erasing signal, and then the transistor Tr 22 is turned ON. After a predetermined period, the transistor Tr 23 is turned ON by the erasing scan line 21, then the capacitor Cs 16 releases the charge and the light emitting element is put into a non-emission state. Thus, a low gray scale display can be performed.

Specifically, a High signal is inputted from the erasing signal line 20 to the transistor Tr 26 in a pixel for a low gray scale display, and the erasing capacitor Cs 27 keeps the transistor Tr 220N. On the other hand, a Low signal is inputted to the transistor Tr 26 in a pixel for a high gray scale display, and the erasing capacitor Cs 27 keeps the transistor Tr 22 OFF. After a predetermined period, the erasing scan lines 21 are selected sequentially. When the transistors Tr 22 and Tr 23 are both turned ON, the light emitting element is put into a non-emission state. That is to say, in this embodiment mode, a pixel is controlled by a selection of erasing scan lines in accordance with the timing at which an erasing signal is outputted from erasing signal lines to put the light emitting element into a non-emission state.

As in Embodiment Modes 1 to 3, an analog voltage corresponding to each gray scale is inputted from the signal line 10 to the transistor Tr 14. A charge corresponding to the inputted analog voltage is stored in the capacitor Cs 16 and the light emitting element 12 emits light at a desired luminance when the driving transistor Tr 17 is turned ON.

By using the lighting period control circuit in this embodiment mode, a timing at which an erasing signal is outputted from the erasing signal line and a timing at which an erasing scan line is selected do not have to be synchronized, therefore, a driver circuit can be controlled simply.

Embodiment Mode 5

In this embodiment mode, a pixel configuration in which a lighting period control circuit is arranged as shown in FIG. 1B is described with reference to FIG. 5.

Figure 5:
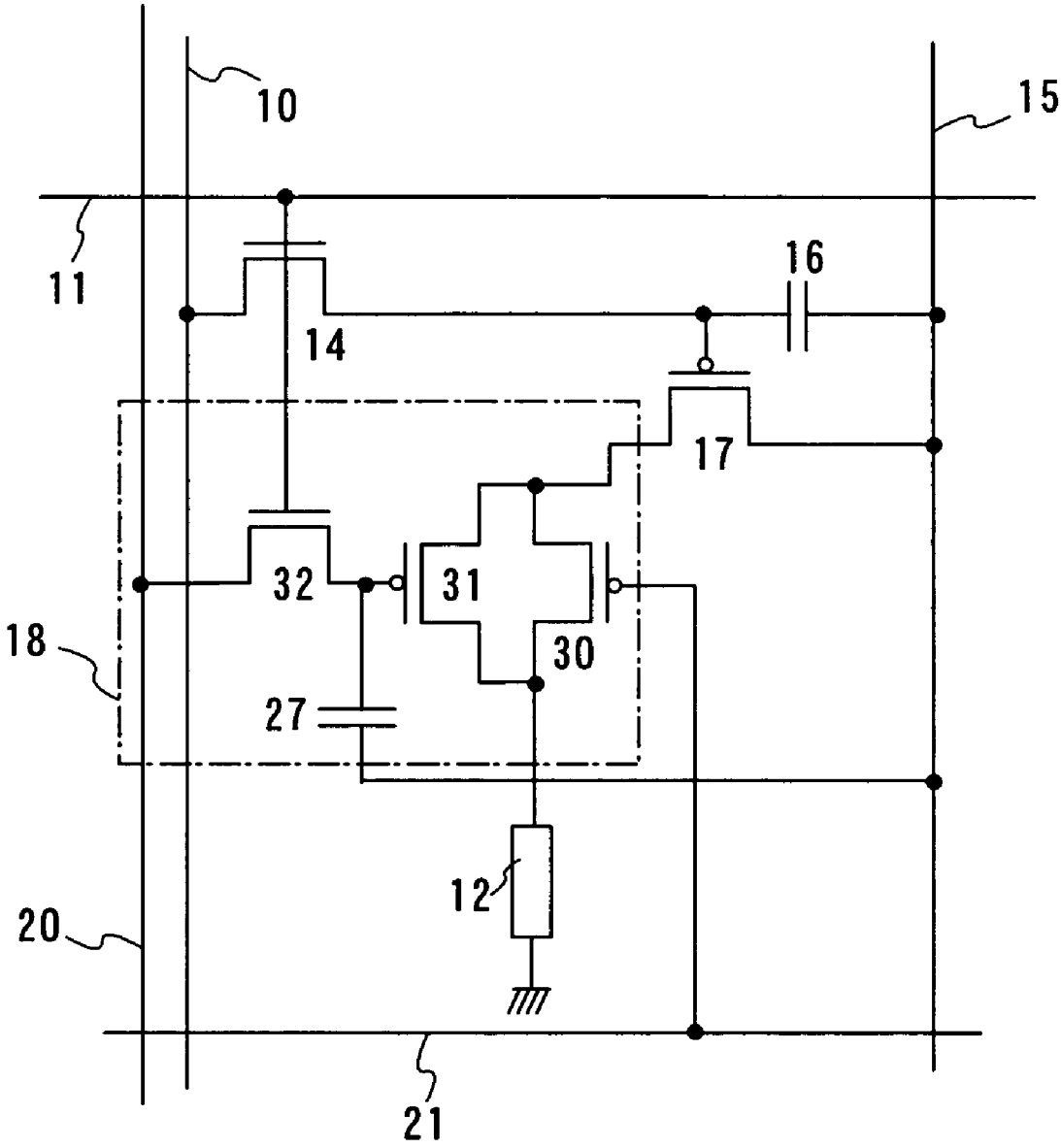
FIG. 5 is a diagram showing a pixel configuration of the display device of the invention.

FIG. 5 shows a pixel configuration including the light emitting element 12 provided at an intersection of the signal line 10 and the scan line 11, the driving transistor Tr 17 connected to the light emitting element 12 via the lighting period control circuit 18, the switching transistor Tr 14 connected to the signal line 10 and the scan line 11, and the capacitor Cs 16 which stores an analog voltage inputted via the switching transistor Tr 14 and provided between the gate electrode of the driving transistor Tr 17 and the power supply line 15. The lighting period control circuit 18 includes a transistor Tr 32 connected to the scan line 11 and the erasing signal line 20, transistors Tr 30 and Tr 31 connected to the transistors Tr 32 and Tr 17 respectively and connected to each other in parallel, the erasing scan line 21 connected to a gate electrode of the transistor Tr 30, and the erasing capacitor Cs 27 connected to the transistor Tr 32 and the power supply line 15. It should be noted in this embodiment that the transistors Tr 30 and Tr 31 are p-channel transistors while the transistor Tr 32 is an n-channel transistor.

Operation of the aforementioned pixel configuration is described now. The operation that an analog voltage is inputted from the signal line and the light emitting element 12 emits light at a predetermined luminance according to the charge stored in the capacitor Cs 16 is the same as Embodiment Modes 1 to 4.

In the case of a low gray scale display, the transistor Tr 32 and the transistor Tr 14 are turned ON at the same time when the scan line 11 is selected. An erasing signal is inputted from the erasing signal line 20 and a charge is stored in the erasing capacitor Cs 27. That is to say, a High signal is inputted as an erasing signal and a charge to turn OFF the transistor Tr 31 is stored in the capacitor Cs 27. At this time, the driving transistor Tr 17 is turned ON and the light emitting element 12 emits light at a predetermined luminance according to the charge stored in the capacitor Cs 16. In the erasing operation, the erasing scan line 21 is selected sequentially to input a High signal, then the p-channel transistor Tr 31 is turned OFF and the light emitting element 12 is put into a non-emission state.

In the case of a high gray scale display, on the other hand, a charge to turn ON the transistor Tr 31 is stored in the capacitor Cs 27. Therefore, the light emitting element 12 emits light when the erasing scan line 21 is selected and a High signal is inputted to turn OFF the transistor 30.

By providing a lighting period control circuit between the light emitting element 12 and the driving transistor Tr 17 in this manner, the light emitting element is put into a non-emission state without fail even when the driving transistor Tr 17 is a normally-on transistor In FIG. 5, the transistors Tr 14 and Tr 32 are connected to the same scan line, however, they may be connected to different scan lines as well. In this case, the light emitting element is put into a non-emission state when a timing at which an erasing signal is outputted from the erasing signal line and a timing at which the erasing scan line is selected are synchronized.

Embodiment Mode 6

Described above is a case of a voltage input, however, the invention can take a current input as well. In the current input, a luminance of a light emitting element is controlled by flowing a current (also referred to as a signal current) to the light emitting element as a video signal. In the case of the current input, multilevel gray scale is displayed according to a value of a signal current flowing to the light emitting element. In this embodiment mode, a case is described where a lighting period control circuit is applied to a pixel of a current input in which an analog current is supplied as a video signal.

Figure 6:
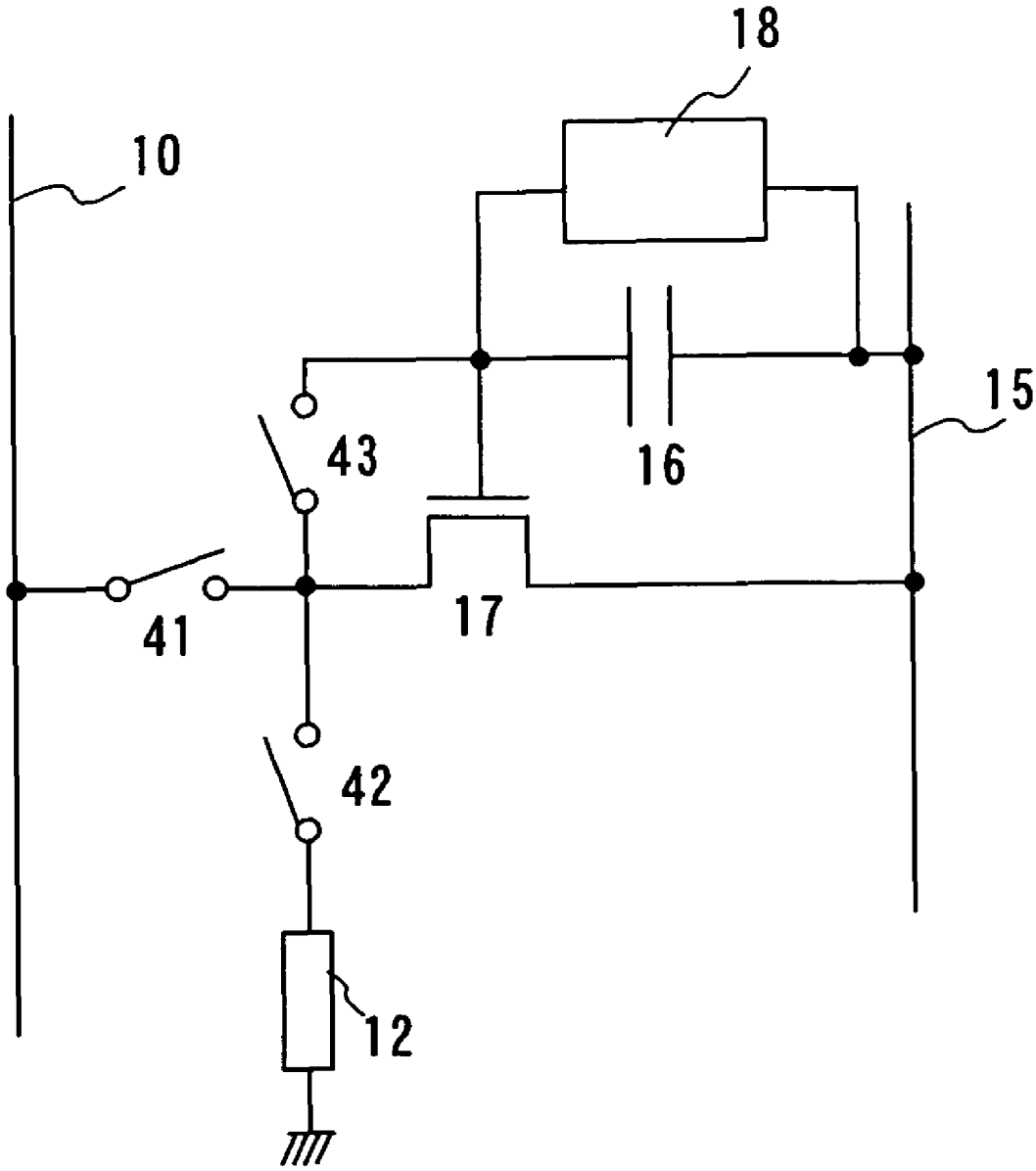
FIG. 6 is a diagram showing a pixel configuration of the display device of the invention.

FIG. 6 shows an example of a pixel of a current input, including a switch Sw 41 connected to the signal line 10, the driving transistor Tr 17 connected to the switch Sw 41, the capacitor Cs 16 provided between a gate electrode of the driving transistor Tr 17 and the power supply line 15, the lighting period control circuit 18 provided at each end of the capacitor Cs 16, a switch Sw 42 connected to the light emitting element 12, and a switch Sw 43 provided at an intersection of the gate electrode of the driving transistor Tr 17, the capacitor Cs 16, the lighting period control circuit 18, and the switch Sw 42.

In the case of a pixel of a current input as described above, an extremely small current is inputted from a signal line when displaying a low gray scale. Then, an accurate current might not be able to be supplied because of a wiring resistance of a signal line and the like. However, by providing a lighting period control circuit of the invention, a lighting period can be controlled with a larger current than a predetermined current. Thus, a writing speed is increased and an accurate low gray scale display can be performed.

Figure 7:
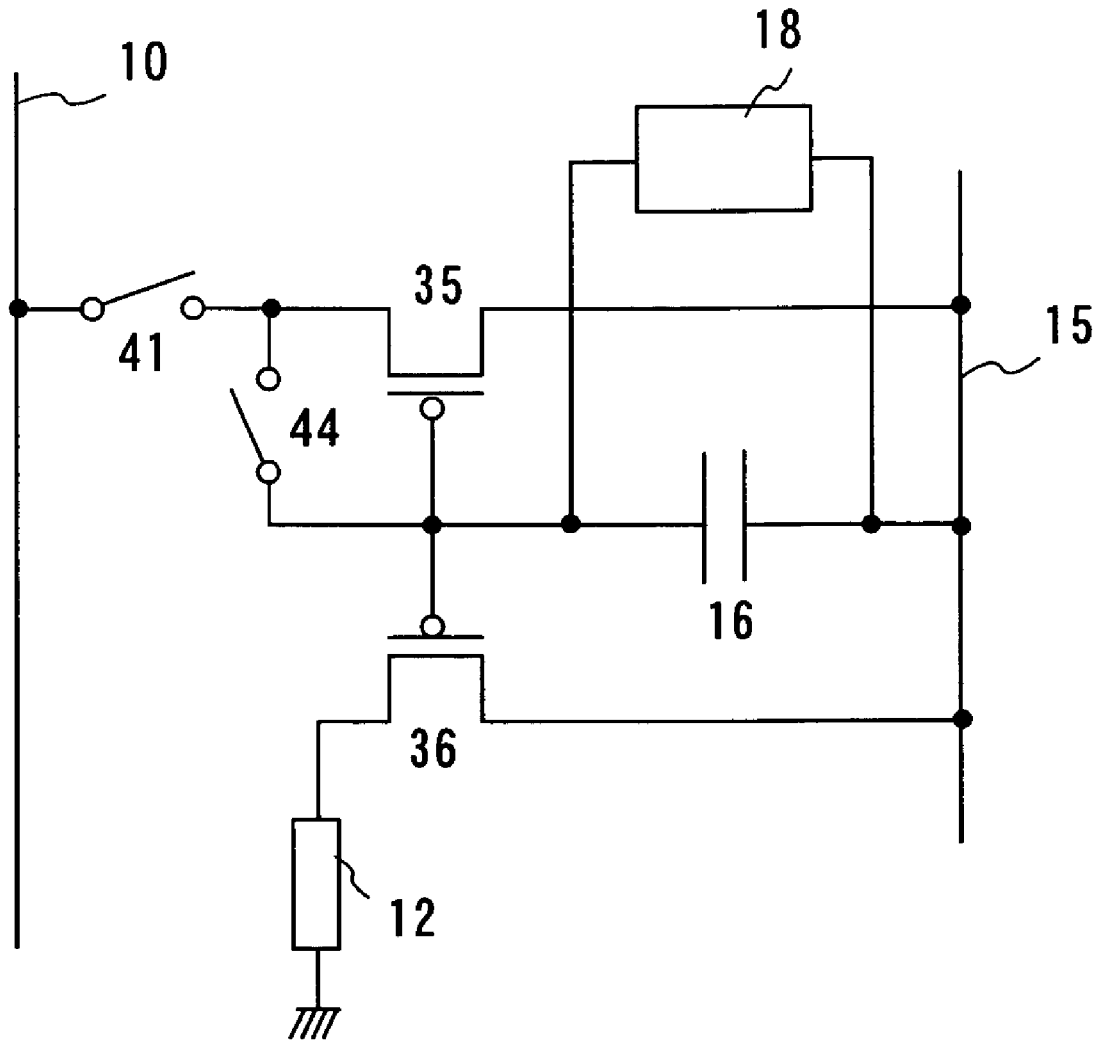
FIG. 7 is a diagram showing a pixel configuration of the display device of the invention.

FIG. 7 shows a pixel configuration of a current input, which is different from FIG. 6. The pixel shown in FIG. 7 includes a switch Sw 41 connected to the signal line 10, a transistor Tr 35 connected to the switch Sw 41, a transistor Tr 36 which configures a current mirror with the transistor Tr 35, a common gate electrode of the transistors Tr 35 and Tr 36, a switch Sw 44 connected to the switch Sw 41, the capacitor Cs 16 connected to the power supply line 15 and the common gate electrode of the transistors Tr 35 and Tr 36, the lighting period control circuit 18 connected to each end of the capacitor Cs 16, and the light emitting element 12 connected to the transistor Tr 36.

In such a pixel configuration including a current mirror circuit, a current inputted via the signal line 10 might be extremely small when displaying a low gray scale as in FIG.

6. However, by providing a lighting period control circuit of the invention, a large current can be supplied even when displaying a low gray scale as well.

In this manner, the lighting period control circuit of the invention can be applied to any pixel of current input. The lighting period control circuit may employ any configurations of Embodiment Modes 1 to 5.

Embodiment Mode 7

In this embodiment mode, an overall structure including a pixel to which the lighting period control circuit in FIG. 2A is applied is described.

Figure 8:
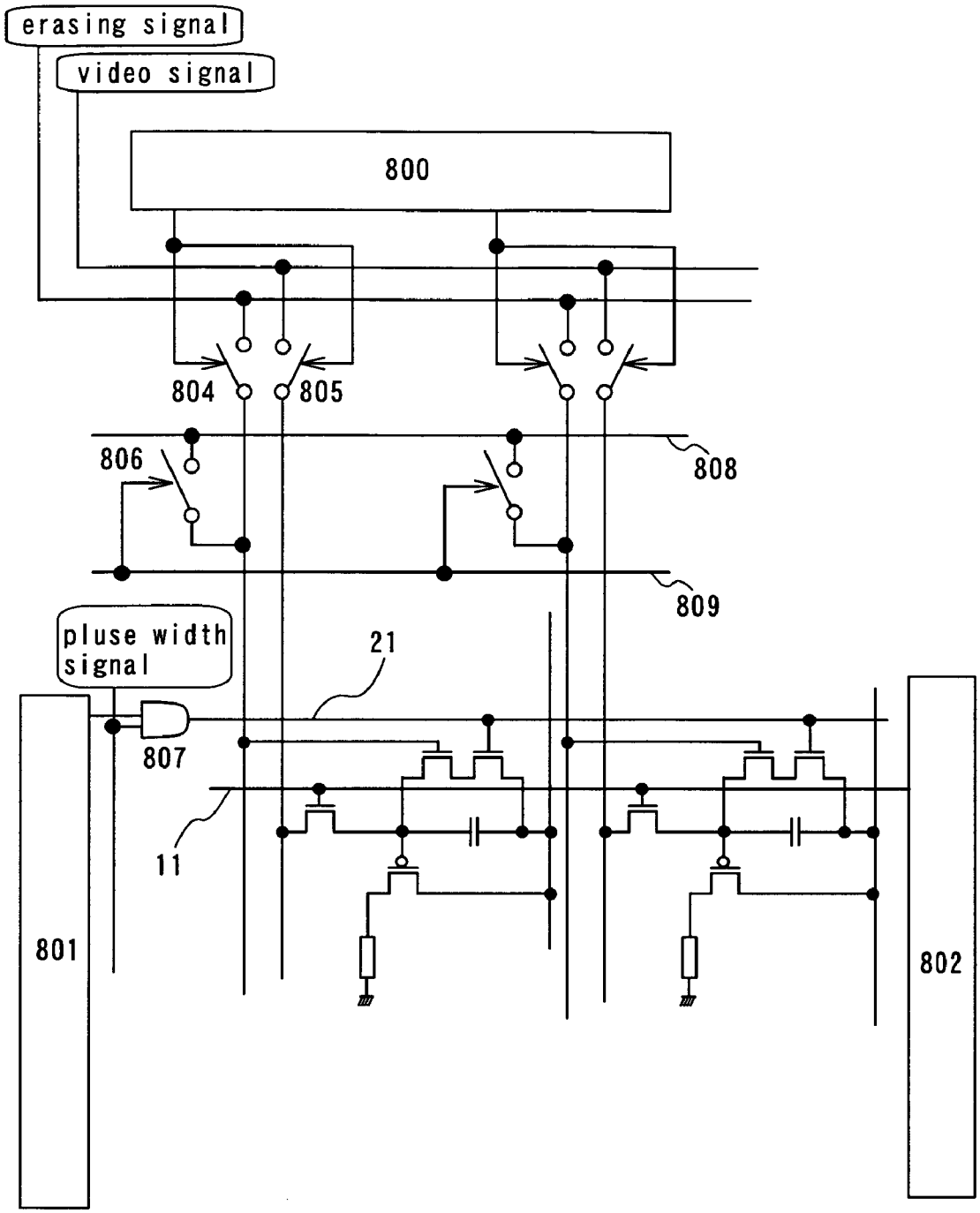
FIG. 8 is a diagram showing a display device of the invention.

FIG. 8 includes switches Sw 804 and Sw 805 connected to wirings to which an erasing signal and a video signal are inputted and a shift register 800 for controlling ON/OFF of the switches Sw 804 and Sw 805. The video signal is inputted to the signal line 10 via the switch Sw 805.

An initialization power supply line 808 and an initialization signal line 809 are provided, and a switch Sw 806 is provided between the initialization power supply line 808 and the switch Sw 804. A selection shift register 802 includes a flip-flop circuit and the like and controls to select the scan line 11 sequentially. An erasing shift register 801 also includes a flip-flop circuit and the like and controls to select the erasing scan line 21 sequentially. It should be noted that an AND circuit 807 which is inputted a pulse width signal is provided between the erasing shift register 801 and the erasing scan line 21.

A reason for providing the AND circuit is described now. In the pixel configuration shown in FIGS. 2A and 2B, when the erasing scan line 21 is selected, a charge in the capacitor Cs 16 is released in the case where a signal to turn ON the transistor Tr 22 is inputted to the erasing signal line 20. That is to say, when an erasing signal of the preceding row remains in the erasing signal line 20, a charge in the capacitor Cs 16 is released and the charge does not return even when a signal to turn OFF the transistor Tr 22 is inputted to the erasing signal line 20 after the erasing scan line 21 is selected. Therefore, when selecting an erasing scan line of a certain row, a potential of the erasing signal lines of a whole row are required to be initialized once so that a charge in the capacitor Cs 16 is not released. For this reason, the AND circuit 807 is provided to which a pulse width signal is inputted. Further, the initialization power supply line 808 and the initialization signal line 809 are provided so that an initialization signal is inputted before the erasing scan line 21 is selected.

Figure 9:
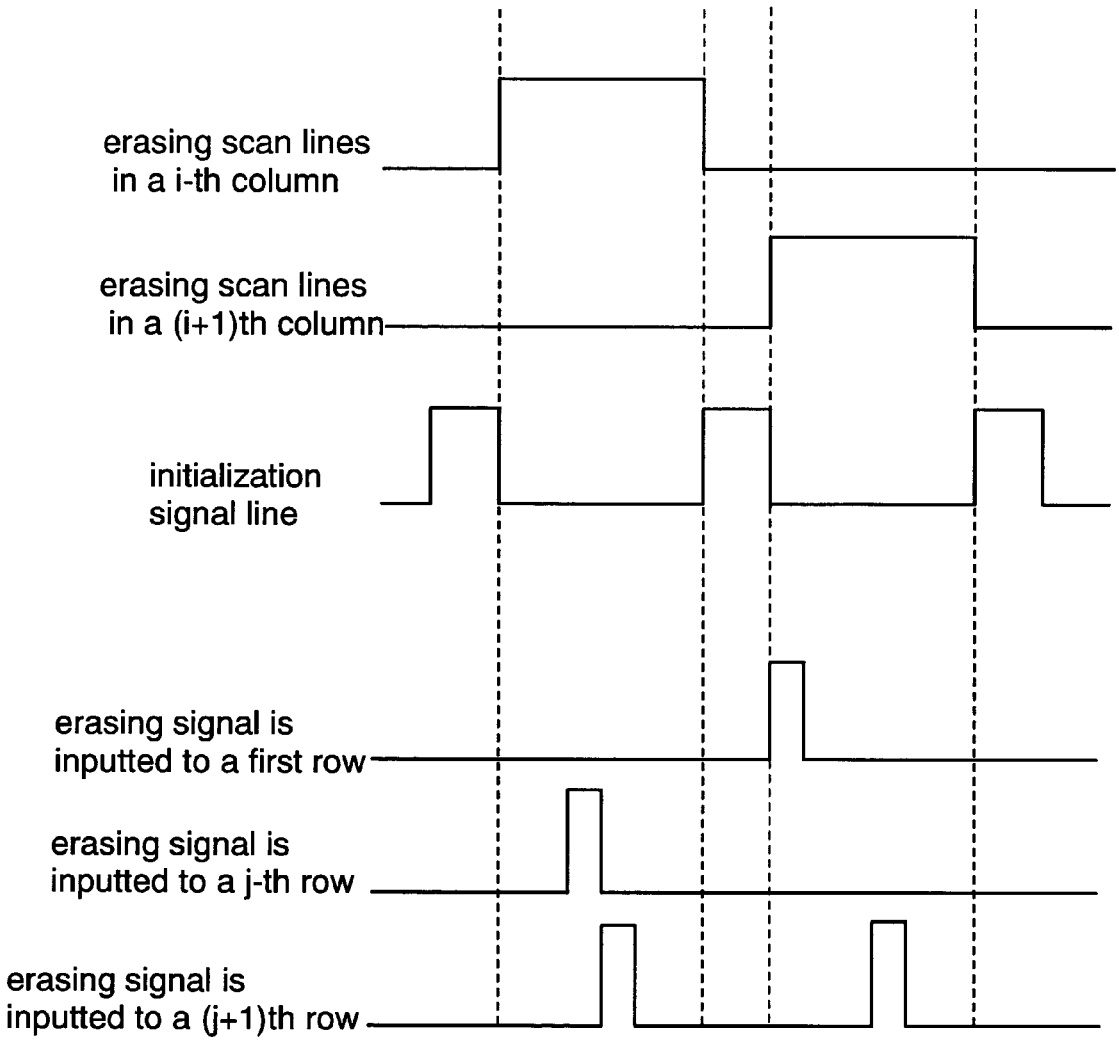
FIG. 9 is a timing chart of a display device of the invention.

A timing chart of the aforementioned operation is described now. FIG. 9 shows an example of the case where pixels in (i+1) th row and first column, i-th row and j-th column, i-th row and (j+1) th column, and (i+1) th row and (j+1) th column are to display low gray scales, that is the case of shortening a lighting period. First, a timing at which erasing scan lines in i-th and (i+1) th rows are selected and a timing at which an initialization signal line is selected are described. A pulse width signal is inputted to one terminal of the AND circuit 807 from the erasing shift register 801. Then, another pulse width signal is inputted to another terminal of the AND circuit 807. The AND circuit outputs a High signal only when a High signal is inputted to both terminals thereof. Therefore, a selection of the erasing scan line is controlled so that a timing at which the initialization signal line is selected and a timing at which the erasing scan line is not selected are synchronized with a timing at which a Low signal is inputted as another pulse signal. In this manner, a High signal can be inputted from the initialization signal line before the erasing scan line in each row is selected and a period in which the erasing scan line for initializing a potential of the erasing signal line is thus not selected can be provided.

A description is made on an erasing signal to be inputted to each pixel for a low gray scale display, namely, each pixel in first row, j-th row, and (j+1) th row. The erasing signal is written sequentially from the erasing signal line to terminate the lighting period. A High erasing signal is inputted before the erasing scan line of a predetermined pixel in which an erasing operation is to be performed is selected. That is to say, in the erasing operation period, a High erasing signal is inputted to a first row of the erasing signal line when an erasing scan line in (i+1) th row is selected, to j-th row of the erasing signal line when i-th column of erasing scan line is selected, and to (j+1) th erasing signal line when i-th column and (i+1) th column of erasing scan line are selected. The light emitting element is put into a non-emission state in synchronization with the aforementioned selection of the erasing scan line and the output of the erasing signal from the erasing signal line.

In this manner, a light emitting element can be put into a non-emission state in each pixel to display a low gray scale.

Embodiment Mode 8

Figure 4:
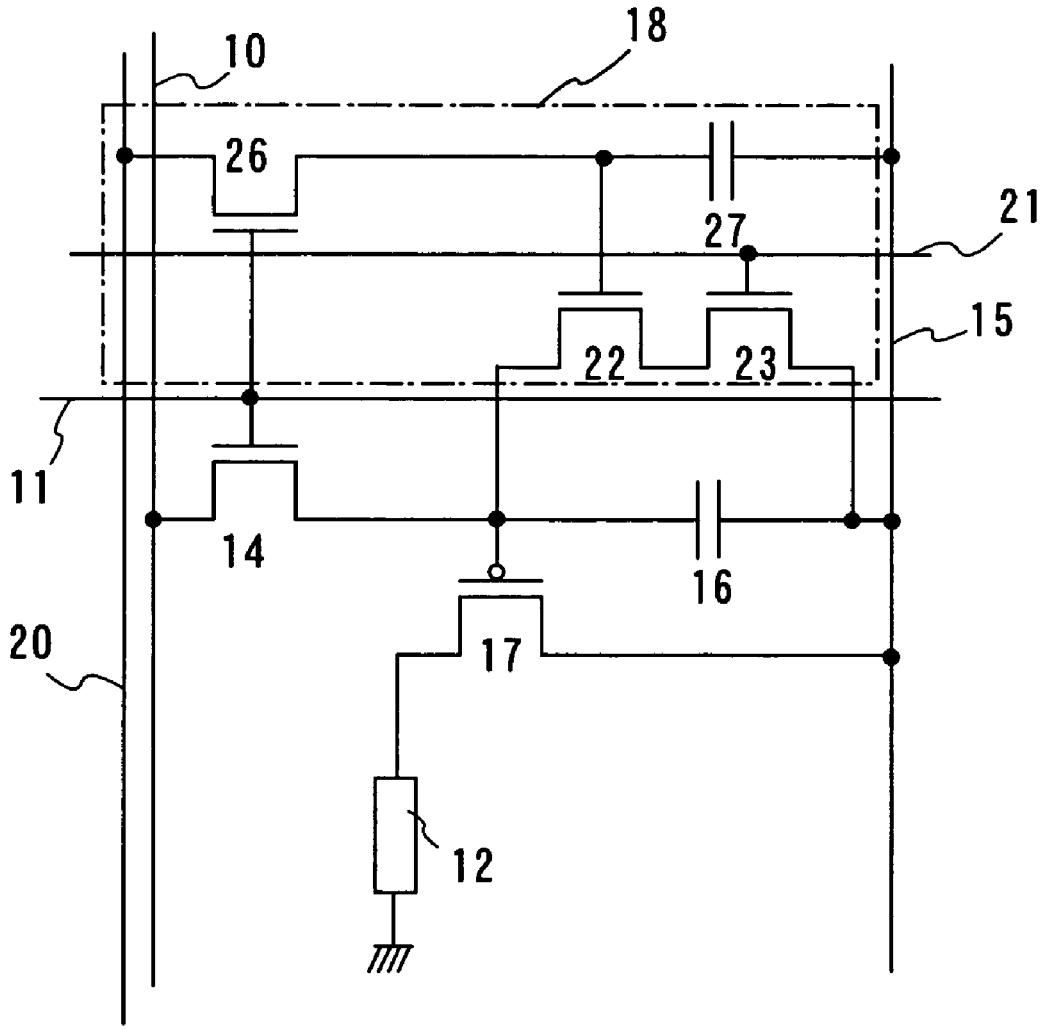
FIG. 4 is a diagram showing a pixel configuration of the display device of the invention.

In this embodiment mode, an overall structure including a pixel to which the lighting period control circuit in FIG. 4 is applied is described.

Figure 10:
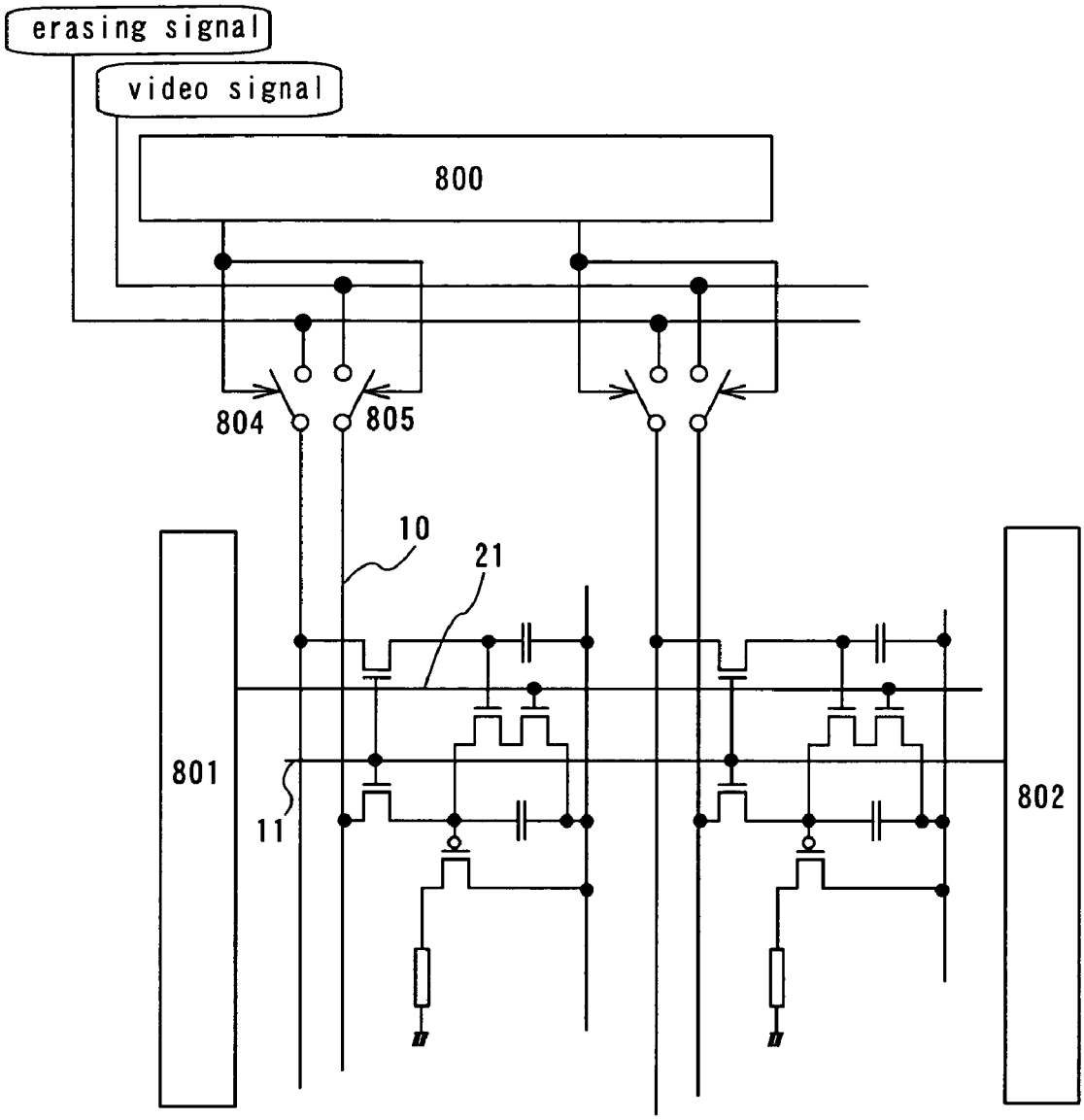
FIG. 10 is a diagram showing a display device of the invention.
Figure 11A:
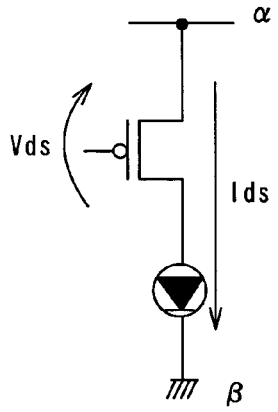
FIGS. 11A, 11B, and 11C are diagrams each showing characteristics of a light emitting element and a transistor.
Figure 11B:
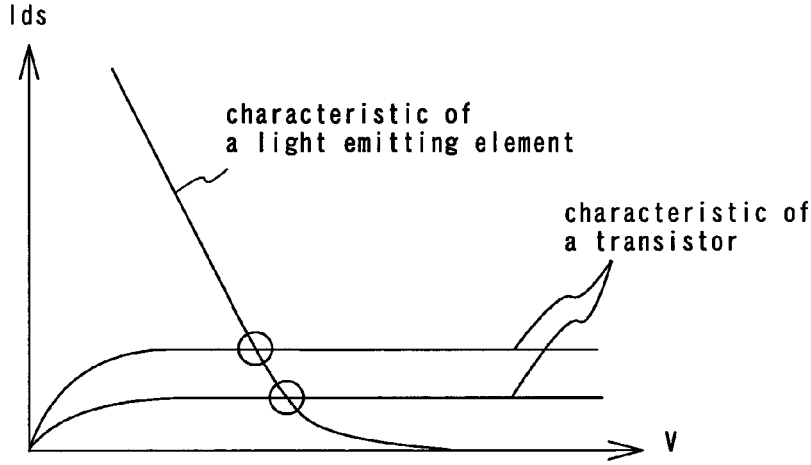
Figure 11C:
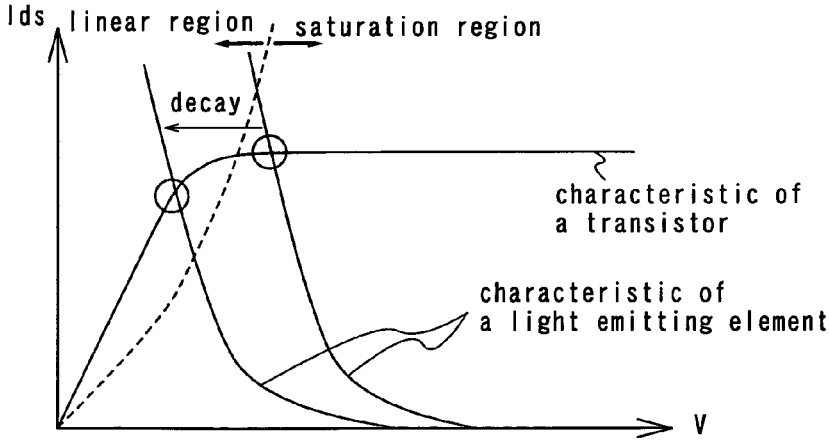

FIG. 10 shows the switches Sw 804 and Sw 805 connected to wirings which are inputted an erasing signal and a video signal respectively and the shift register 800 for controlling ON/OFF of the switches Sw 804 and Sw 805. Further, the erasing shift register 801 for controlling a selection of the erasing scan line 21 and the selection shift register 802 for controlling a selection of the scan line 11 are included. A video signal is inputted to the signal line 10 via the switch Sw 805.

In the aforementioned pixel configuration, only a video signal and an erasing signal are required to be inputted. Therefore, a switch or other logic circuits do not have to be provided, which makes a structure of a display device simpler.

Embodiment Mode 9

In this embodiment mode, another effect of providing a lighting period control circuit in each pixel is described.

In displaying a multilevel gray scale by a time gray scale method in which one frame is divided into a plurality of subframes by using the digital gray scale method as described above, a pseudo contour may appear A pseudo contour can be prevented by using the lighting period control circuit of the invention and changing the order of subframes in each pixel. For example, an order of the subframes or a time to start or terminate the subframe period are changed in each row or each pixel so that the emission and non-emission are performed randomly in each pixel. Thus, a visible pseudo contour is decreased by narrowing an area in which an emission and non-emission are performed alternately.

Figure 13A:
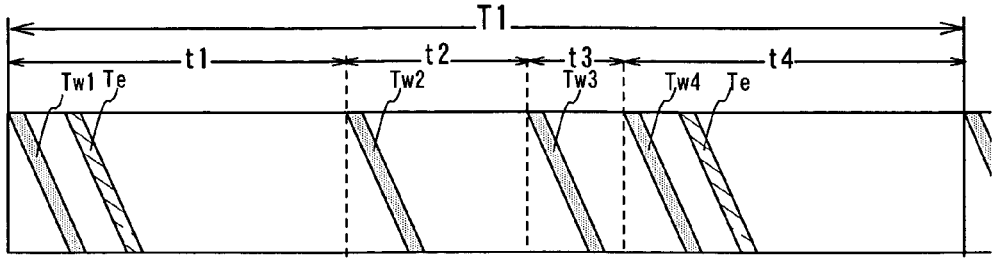
FIGS. 13A and 13B are timing charts of a display device of the invention.
Figure 13B:
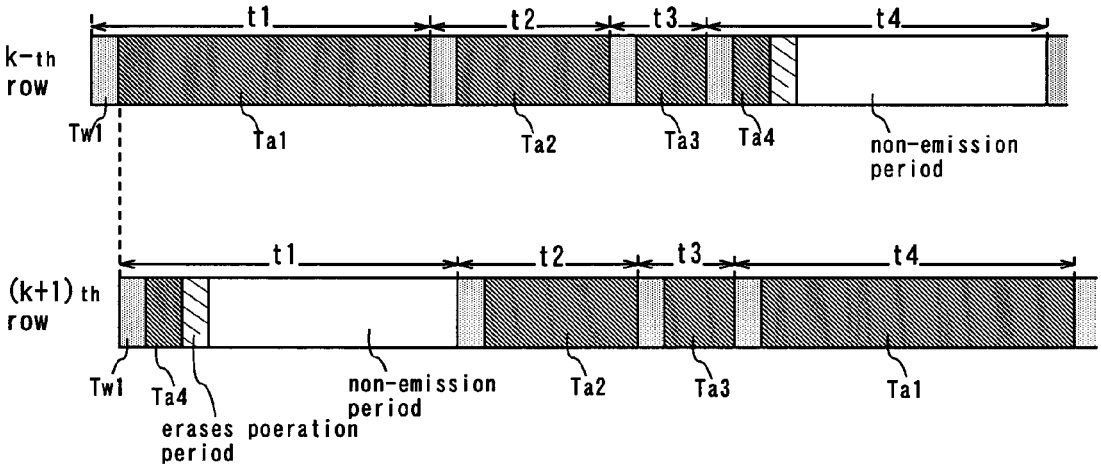

Specifically, a case of changing a time for terminating a lighting period in subframes in the pixels of k-th row and (k+1) th row by using the lighting period control circuit as shown in FIGS. 13A and 13B is described.

FIG. 13A is a timing chart of 4-bit 16-level gray scale display in which one frame denoted as T is divided into four subframes denoted as t1 to t4. As shown in FIG. 13A, each of the periods t1 to t4 includes write operation periods Tw1 to Tw4 respectively in which a signal is written from the signal line. And each of the periods t1 and t4 includes an erasing operation period Te.

FIG. 13B shows a state of the pixels in k-th row and (k+1) th row in the case of displaying a 16-level gray scale, that is the case of displaying white by emitting light in all subframe periods. In the period t1, writing Tw1 is carried out to the pixels in k-th row, which starts a lighting period Ta1. At this time, writing Tw1 is also carried out to the pixels in (k+1) th row, and a lighting period Ta4 starts, and an erasing operation Te erases the written signal follows. In the period t2, writing Tw2 is carried out to the pixels k-th row and a lighting period Ta2 starts. At this time in (k+1) th row, writing Tw2 is also carried out and a lighting period Ta2 starts. In the period t3, writing Tw3 is carried out to the pixels in k-th row and a lighting period Ta3 starts. At this time in (k+1) th row, writing Tw3 is also carried out and a lighting period Ta3 starts. In the period t4, writing Tw4 is carried out to the pixels in k-th row and a lighting period Ta4 starts, and an erasing operation Te erases the written signal follows. At this time in (k+1) th row, writing Tw4 is also carried out and a lighting period Ta1 starts.

In displaying other than white, an order of lighting periods may also be changed. Further, in displaying other than 16-level gray scale also, an order of lighting periods may be changed as well.

In the erasing operation period, specifically, erasing scan lines are sequentially selected. When an erasing signal is inputted from the erasing signal line, a light emitting element is put into a non-emission state. Therefore, length of lighting periods can be controlled and an order of lighting periods can be changed. In FIGS. 13A and 13B, a time to start the lighting period Ta4 can be changed considerably in each row.

In FIGS. 13A and 13B, two erasing operations are provided for which the lighting period control circuit as shown in FIGS. 3A and 3B may be used, for example. It is needless to say that any lighting period control circuit other than the one shown in FIGS. 3A and 3B may be used.

Figure 14A:
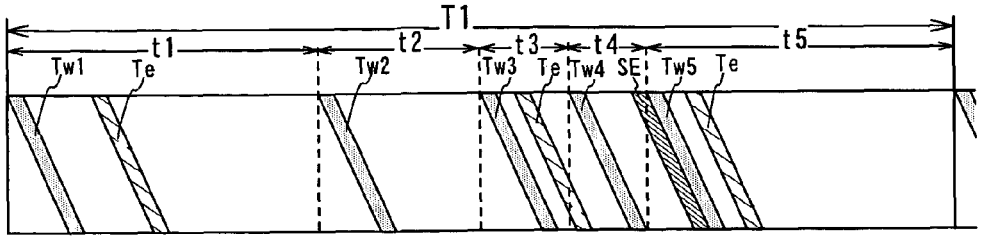
FIGS. 14A and 14B are timing charts of a display device of the invention.

FIG. 14A is a timing chart of 32-level gray scale display in which one frame denoted as T is divided into five subframes denoted as t1 to t5. Note that a erasing period SE is provided. The erasing period SE is provided because a duty ratio is decreased when the time gray scale method is employed to display a multilevel gray scale, that is when each subframe is shortened. By providing the erasing period SE, a write operation period can be provided while putting a light emitting element in a non-emission state, thus a duty ratio can be prevented from decreasing.

In FIG. 14A, each of the periods t1 to t5 has a write operation period Tw1 to Tw5 respectively in which a signal is written from the signal line, and a first erasing operation Te is provided in the periods t1, t3 and t5 and a erasing period SE is provided in the period t4.

Figure 14B:
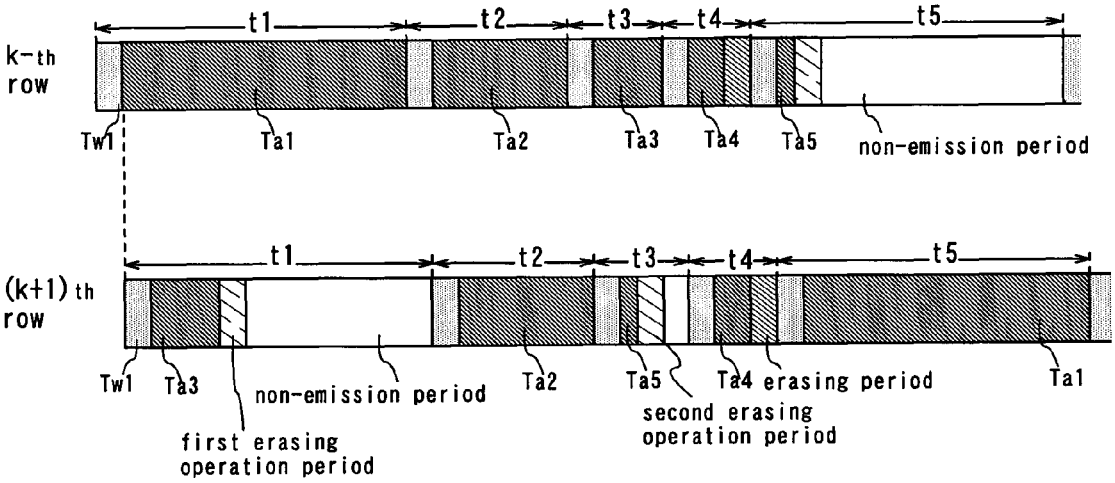

FIG. 14B shows a state of k-th row and (k+1) th row in the case of displaying 32-level gray scale, that is the case of displaying white by emitting light in all subframe periods. In the period t1, writing Tw1 is carried out to the pixels in k-th row and a lighting period Ta1 starts. At this time, writing Tw1 is also carried out to the pixels in (k+1) th row, and a lighting period Ta3 starts, and an erasing operation Te erases the written signal follows. In the period t2, writing Tw2 is carried out to the pixels in k-th row and a lighting period Ta2 starts. At this time in (k+1) th row, writing Tw2 is also carried out and a lighting period Ta2 starts. In the period t3, write Tw3 is carried out to the pixels in k-th row and a lighting period Ta3 starts. At this time in (k+1) th row, writing Tw3 is also carried out and a lighting period Ta5 starts. In the period t4, writing Tw4 is carried out to the pixels in k-th row and a lighting period Ta4 starts and an erasing period SE erases the written signal follows. At this time in (k+1) th row, writing Tw4 is also carried out and a lighting period Ta4 starts and an erasing period SE erases the written signal. In the period t5, writing Tw5 is carried out to the pixels in k-th row and a lighting period Ta5a starts, and first erasing operation Te erases the written signal follows. At this time in (k+1) th row, writing Tw5 is also carried out and a lighting period Ta1 starts.

In displaying other than white, an order of lighting periods may be changed. Further, in displaying other than 32-level gray scale also, an order of lighting periods may be changed.

In the erasing operation period, specifically, erasing scan lines are sequentially selected. When an erasing signal is inputted from the erasing signal line, a light emitting element is put into a non-emission state. Therefore, length of lighting periods can be controlled.

In FIGS. 14A and 14B, three first erasing operations are provided. For example, they may be utilized in the case of applying the lighting period control circuit as shown in FIGS. 3A and 3B by increasing erasing scan lines, erasing signal lines, and transistors. Further, other lighting period control circuits may be applied as well.

The order to change the subframes or the number of erasing operations are not limited to FIGS. 13A, 13B, 14A and 14B. Any lighting period control circuits in Embodiment Modes 1 to 5 may be used.

In this manner, by changing the order of lighting periods in each row, that is by changing the time to terminate the lighting period, a pseudo contour can be prevented from appearing. Further, it is more preferable that the order of lighting periods be changed in each row, column, and pixel. In particular, a pseudo contour may be prevented by chaging the order of lighting periods in each adjacent pixel.

Embodiment Mode 10

In this embodiment mode, a pixel configuration including two driving transistors and an analog signal, in particular an analog voltage is inputted as a video signal is described. For example, a pixel configuration including first and second transistors and a lighting period control circuit is described.

Figure 16A:
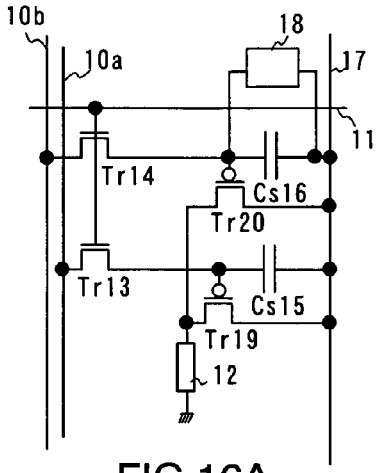
FIGS. 16A to 16E are diagrams showing pixel configurations of the display device of the invention.

FIG. 16A shows a pixel configuration including a first signal line 10*a*, a second signal line 10*b*, the scan line 11, and the light emitting element 12. The pixel includes a first switching transistor Tr 13 connected to the first signal line 10*a*, a second switching transistor Tr 14 connected to the second signal line 10*b*, capacitors Cs 15 and Cs 16 connected to the transistors Tr 13 and Tr 14 respectively, a power supply line 17 connected to the other ends of the capacitors Cs 15 and Cs 16, the lighting period control circuit 18 connected to each end of the capacitor Cs 15, a first driving transistor Tr 19 connected to the light emitting element 12 and the power supply line 17, and a second driving transistor Tr 20 connected to the light emitting element 12 and the power supply line 17. It should be noted in this embodiment mode that the transistors Tr 13 and Tr 14 are n-channel transistors while the transistors Tr 19 and Tr 20 are p-channel transistors.

W/L of the driving transistor Tr 20 is designed to be smaller than W/L of the driving transistor Tr 19. When designing W/L small, a value of either L or W may be formed larger or both of them may be formed larger. In this manner, Vgs of the driving transistors becomes higher and an effect of a variation in Vth of the driving transistors can be decreased.

Described now is the case of a high gray scale display in the aforementioned pixel configuration. When the transistors Tr 13 and Tr 14 are selected by the scan line 11, an analog voltage is inputted from the first signal line 10*a* and the second signal line 10*b* so as to obtain a predetermined luminance. Charges are stored in the capacitors Cs 15 and Cs 16 according to the inputted voltage, and the transistors Tr 19 and Tr 20 are turned ON. Then the light emitting element emits light. Each of the capacitors Cs 15 and Cs 16 stores a voltage between the gate and source of the transistors Tr 19 and Tr 20 respectively. At this time, a sum of the current from the transistors Tr 19 and Tr 20 is supplied to the light emitting element to perform a high gray scale display. It is needless to say that only the transistor Tr 19 may be used for the high gray scale display.

Figure 16B:
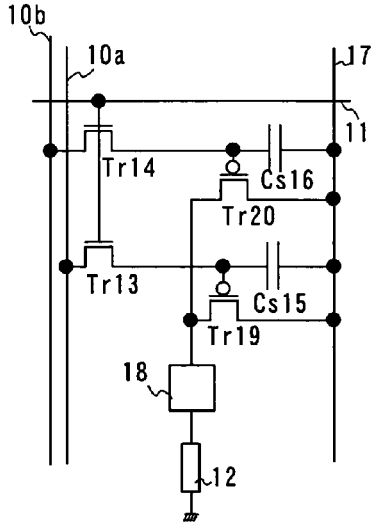
Figure 16C:
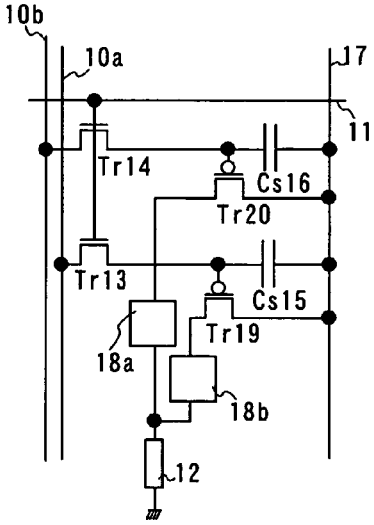
Figure 16D:
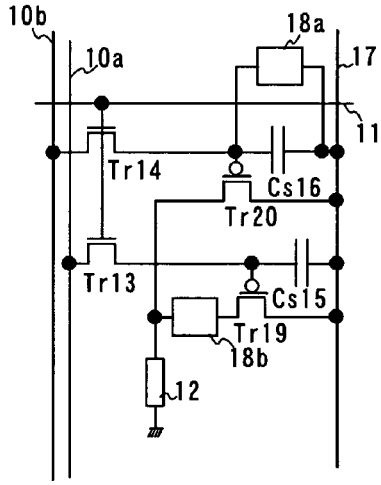
Figure 16E:
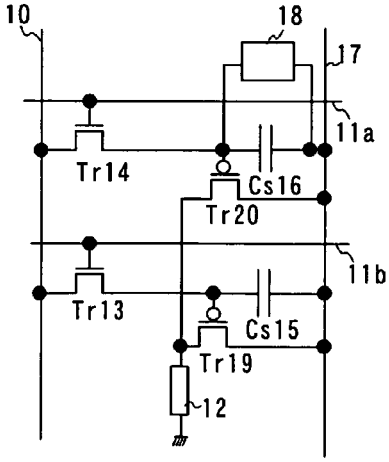

In this embodiment mode, the first and second signal lines are used to supply an analog voltage in the case of a high gray scale display, however, only one signal line may be used to supply an analog voltage as a first signal line only is used in FIG. 16E.

Described now is the case of a low gray scale display. The transistors Tr 13 and Tr 14 are selected by the scan line 11 as is in the high gray scale display. At this time, a signal is inputted so that a current flows only to the transistor Tr 20, therefore, Vgs of the driving transistors becomes higher. In the case of a low gray scale display, a light emission of the light emitting element 12 is controlled to be short by the lighting period control circuit 18, namely a period that the transistor Tr 20 supplies a current to the light emitting element 12 is controlled to be short. As a result, Vgs of the driving transistors can be further higher.

In FIG. 16A, the lighting period control circuit 18 is disposed at each end of the capacitor Cs 15, however, another lighting period control circuit may be additionally disposed at each end of the capacitor Cs 16. Thus, a current to flow in each transistor, a value of Vgs of the driving transistors, and a lighting period are controlled in accordance with gray scale. It should be noted that the number and arrangement of the lighting period control circuit may be set by a practitioner based on the design of a display (the number of gray scale and the like).

The lighting period control circuit 18 is preferably such a circuit as to release a charge stored according to the analog voltage after a predetermined lighting period, that is a circuit to turn OFF the transistor Tr 20. For example, a transistor or a capacitor may be employed in the lighting period control circuit 18 for such a purpose.

The lighting period control circuit 18 may be disposed so that it can control a time for supplying a predetermined current to the light emitting element. For example, it may be disposed between the light emitting element 12 and the driving transistors Tr 19 and Tr 20 as shown in FIG. 16B.

When disposing the lighting period control circuit as shown in FIG. 16B, an erasing operation period can be provided without fail regardless of the characteristics of the driving transistors Tr 19 and Tr 20, in particular threshold voltages (Vth) thereof. That is to say, in the case where the driving transistors Tr 19 and Tr 20 are normally-on transistors which flow a current when a voltage is zero, the lighting period control circuit blocks a connection between the light emitting element 12 and the transistor Tr 17, therefore, the erasing operation period can be surely provided to perform a low gray scale display.

In the case of a pixel configuration shown in FIG. 16B, a light emission of the light emitting element 12 can be controlled in a high gray scale display as well. That is to say a light emission of the light emitting element 12 can be controlled in both a high gray scale display and a low gray scale display by using the lighting period control circuit 18.

As an example of providing a plurality of lighting period control circuits, two lighting period control circuits 18*a* and 18*b* may be provided between the transistor Tr 19 and the light emitting element 12 and between the transistor Tr 20 and the light emitting element 12 respectively as shown in FIG. 16C.

Further, the two lighting period control circuits 18*a* and 18*b* may be disposed at each end of the capacitor Cs 16 and between the transistor Tr 19 and the light emitting element 12 respectively as shown in FIG. 16D.

FIG. 16E shows an example in which the first signal line 10*a* and the second signal line 10*b* are replaced with a signal line 10. A first scan line 11*a* and a second scan line 11*b* are connected to the transistors Tr 13 and 14 respectively.

By disposing two lighting period control circuits in this manner, a higher Vgs of the driving transistors can be obtained since both of them can put the light emitting element into a non-emission state. As a result, an effect of a variation in Vth of the driving transistors can be considerably decreased.

It should be noted that the driving transistors are p-channel transistors in the description above, however, they may be n-channel transistors as well. Further, it is also possible that all the transistors have the same polarity of either n-channel or p-channel.

That is, the invention provides a plurality of driving transistors for displaying a high gray scale and a low gray scale and makes it possible to display a low gray scale accurately by using the lighting period control circuit provided in each pixel. It should be noted that a pixel configuration, a structure and a polarity of the transistor, or an arrangement or the number of the lighting period control circuit are not limited to FIGS. 16A to 16E.

Embodiment Mode 11

In this embodiment mode, a specific example of a pixel configuration in which the lighting period control circuit is disposed at each end of the capacitor Cs 16 as shown in FIG. 16A is described with reference to FIGS. 17A and 17B.

Figure 17A:
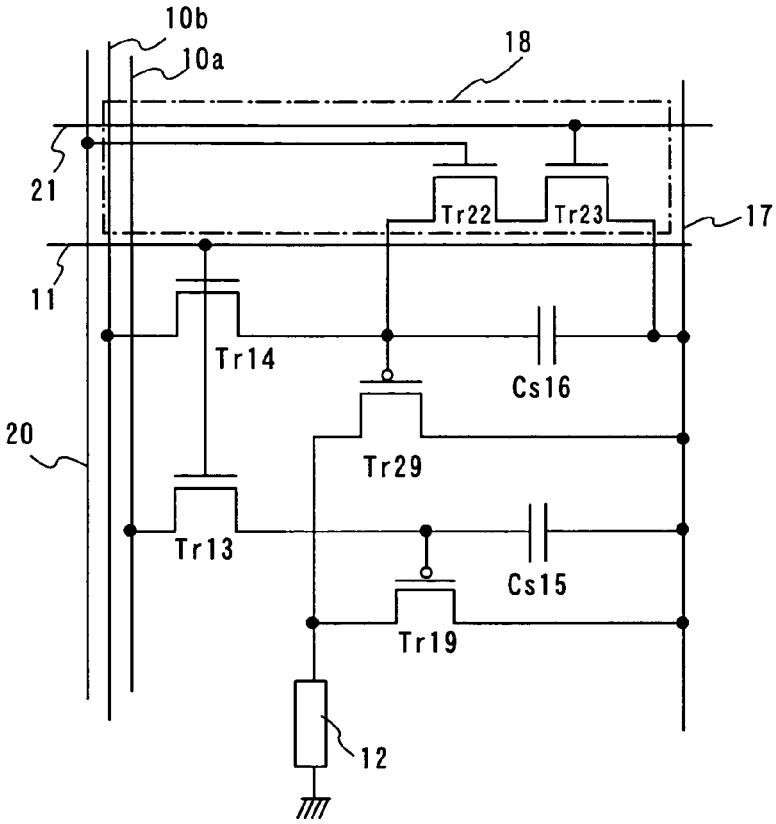
FIGS. 17A and 17B are diagrams showing pixel configurations of the display device of the invention.

A pixel shown in FIG. 17A includes the switching transistors Tr 13 and 14 connected to the scan line 11 and the first signal line 10*a* and the second signal line 10*b* respectively, the capacitors Cs 15 and Cs 16 connected to the switching transistors Tr 13 and Tr 14 respectively, the driving transistor Tr 19 of which gate electrode is connected to the switching transistor Tr 13 and the capacitor Cs 15, the driving transistor Tr 29 of which gate electrode is connected to the switching transistor Tr 14 and the capacitor Cs 16, the light emitting element 12 connected to one of the driving transistors Tr 19 and Tr 29, and a power supply line 17 connected to the other of the driving transistors Tr 19 and Tr 29. The lighting period control circuit 18 including the transistors Tr 22 and Tr 23 connected in series is provided at each end of the capacitor Cs 16, the gate electrode of the transistor Tr 22 is connected to the erasing signal line 20, and the gate electrode of the transistor Tr 23 is connected to the erasing scan line 21. It should be noted in this embodiment that the transistors Tr 13, Tr 14, Tr 22, and Tr 23 are n-channel transistors while the transistors Tr 19 and Tr 29 are p-channel transistors.

W/L of the driving transistor Tr 29 is designed to be smaller than that of the driving transistor Tr 19. In this manner, Vgs of the driving transistors becomes higher and an effect of a variation in Vth of the driving transistors can be decreased.

Operation of the aforementioned pixel configuration is described now. In the case of a high gray scale display, the transistors Tr 13 and Tr 14 are selected by the scan line 11 and an analog voltage is inputted from the first signal line 10*a* and the second signal line 10*b* so as to obtain a predetermined luminance. Charges are stored in the capacitors Cs 15 and 16 according to the inputted voltage, and the transistors Tr 19 and Tr 29 are turned ON. Then the light emitting element emits light. At this time, a sum of a current flowing from the transistors Tr 19 and Tr 20 or a current from the transistor Tr 19 only is supplied to the light emitting element 12 and a high gray scale display can be performed.

It should be noted in this embodiment mode that an analog voltage is supplied by using the first and second signal lines in the case of a high gray scale display, however, only the first signal line may be used for supplying an analog voltage.

In the case of a low gray scale display, an analog voltage is supplied from the second signal line 10*b* connected to the capacitor Cs 16 via the transistor Tr 14 to which the lighting period control circuit 18 is connected. The analog voltage can be increased in this low gray scale display. Further in a low gray scale display, the light emitting element 12 is put into a non-emission state for a predetermined period by using the lighting period control circuit 18. At this time, an analog voltage inputted from the signal lines has a value according to a lighting period.

Specifically, the erasing scan line 21 is selected and the transistor Tr 23 is turned ON. An erasing signal is inputted from the erasing signal line 20 in synchronization with the transistor Tr 23 being ON, thus the transistor Tr 22 is turned ON. When the transistors Tr 22 and Tr 23 are both turned ON, a charge stored in the capacitor Cs 15 is released and the light emitting element 12 is put into a non-emission state. The light emitting element keeps emitting light since the charge in the capacitor Cs 15 is not released as the transistor Tr 22 is OFF even when the transistor Tr 23 is ON in other pixels. Thus, a lighting period can be controlled in each pixel.

Pixels are actually arranged in matrix and an analog voltage is inputted in accordance with the scan lines selected sequentially. Therefore, a timing at which the erasing scan line 21 is selected is slower than a timing at which the scan line 11 is selected. Note that the timing at which the erasing scan lines are selected can be determined by a practitioner appropriately according to the length of a lighting period.

Figure 17B:
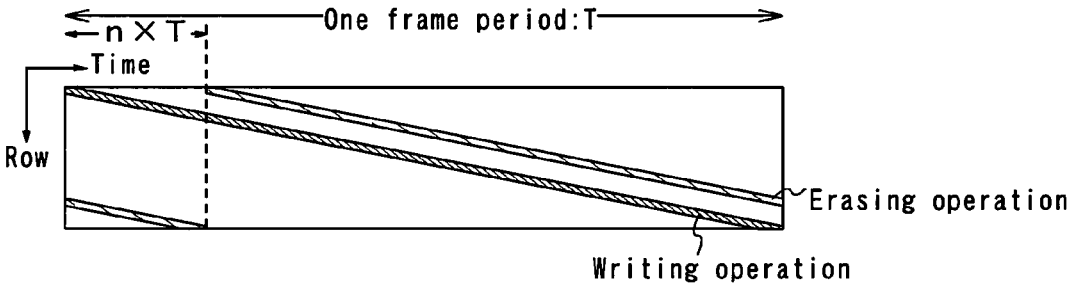

FIG. 17B shows a timing chart showing the timing at which the erasing scan lines are selected after n×T (0<n<1). As time passes, a scan line in each row is selected sequentially and either or both of the transistors Tr 13 and Tr 14 are turned ON per column and an analog voltage is supplied from the signal line 10. After that, a charge according to the inputted analog voltage is stored in the capacitors Cs 15 and Cs 16, thus turning ON the transistors Tr 19 and Tr 29. Then, the light emitting element 12 starts emitting light at a luminance according to each inputted analog voltage.

The erasing scan line in each row is sequentially selected after n×T and the transistors Tr 23 are turned ON per column. However, a pixel in which an erasing operation is actually performed, that is for performing a low gray scale display, varies in each column. Therefore, an erasing signal is inputted into the transistor Tr 22 via the erasing signal line 20 only in a pixel for a low gray scale display. As a specific erasing signal, a High signal is inputted from the erasing signal line 20, thus the n-channel transistor Tr 22 is turned ON. That is to say, in synchronization with the timing at which the erasing scan line 21 is selected, the light emitting element 12 in the pixel which is inputted an erasing signal from the erasing signal line 20 is put into a non-emission state, thus a low gray scale display is performed.

A timing at which a scan line and an erasing scan line are selected is described by specifying a value.

In the case of displaying 64-level gray scale, a scan line is selected and an analog voltage corresponding to each gray scale is inputted from the signal line to the pixel in one frame period T. In the low gray scale from one to eight levels, a lighting period is set short.

A description is made on a specific the number of gray scale levels or a value of a video signal in the case where an erasing operation period is provided after (¼=0.25)T, (W/L of the transistor Tr 19): (W/L of the transistor Tr 29)=2:1 is satisfied, and the lighting period control circuit 18 is connected to the transistor Tr 29 as shown in FIGS. 17A and 17B. Note that Chart 1 shows an example of the number of gray scale levels (luminance), a lighting period (0.25 or 1.1 indicates that an erasing operation is not carried out), a relative proportion of video signals to the transistors Tr 29 and Tr 19, and a relative proportion of a current flowing to the light emitting element 12.

[Chart 1]

In the case of displaying 1-level gray scale, a video signal corresponding to 4-level gray scale is inputted to the transistor Tr 29. At this time, the lighting period is set at (¼)T by using the lighting period control circuit 18. Then, a current flowing to the light emitting element 12 has a value of 1. However, the current value is expressed relatively here and it is not an actual current value. In this manner, the lighting period is shortened by using the lighting period control circuit 18 and a low gray scale display (up to 16-level gray scale in Chart 1) is performed.

In the case of displaying 32-level gray scale, the transistor Tr 19 may be used, to which a video signal corresponding to 16-level gray scale is inputted. At this time, a relative proportion of W/L of the transistor Tr 19, that is a current capacity thereof is twice as large as that of the transistor Tr 29, therefore, a current flowing to the light emitting element has a value of 32.

In the case of displaying 33-level gray scale, the transistors Tr 19 and Tr 29 may be used. A video signal corresponding to 16-level gray scale is inputted to the transistor Tr 19 and video signal corresponding to 4-level gray scale is inputted to the transistor Tr 29. Further, a lighting period is set at (¼)T by using the lighting period control circuit 18. As a result, a current flowing to the light emitting element 12 has a value of 32+1=33.

A length of the lighting period may be determined by a practitioner appropriately. That is, a gray scale region of a low gray scale display is preferably set considering a timing of an erasing operation (length of a lighting period) so as not to exceed a maximum gray scale of a display device.

An analog voltage is inputted from the first or second signal line. Specifically, an analog voltage in the case of a low gray scale display is required to be inputted from the second signal line 10*b*. On the other hand, an analog voltage in the case of a high gray scale display is inputted from the first signal line 10*a*, or may be inputted from both first and second signal lines 10*a* and 10*b*.

By providing the lighting period control circuit in this manner, an accurate low gray scale display can be performed. That is to say, according to the invention, a pixel can be designed so that Vgs of a driving transistor becomes high. Furthermore, an effect of a variation in threshold voltage of driving transistors can be decreased while widening an operation region in a saturation region as an operation region in order to prevent a luminance decay due to a degradation of a light emitting element.

In this embodiment mode, the lighting period control circuit 18 may be connected to the capacitor Cs 15 or two lighting period control circuits may be connected to each of the capacitors Cs 15 and Cs 16 respectively. By providing two lighting period control circuits, each of which can put the light emitting element into a non-emission state, a higher Vgs of driving transistors can be obtained. As a result, an effect of a variation in Vth of the driving transistors can be considerably decreased.

Embodiment Mode 12

Figure 18A:
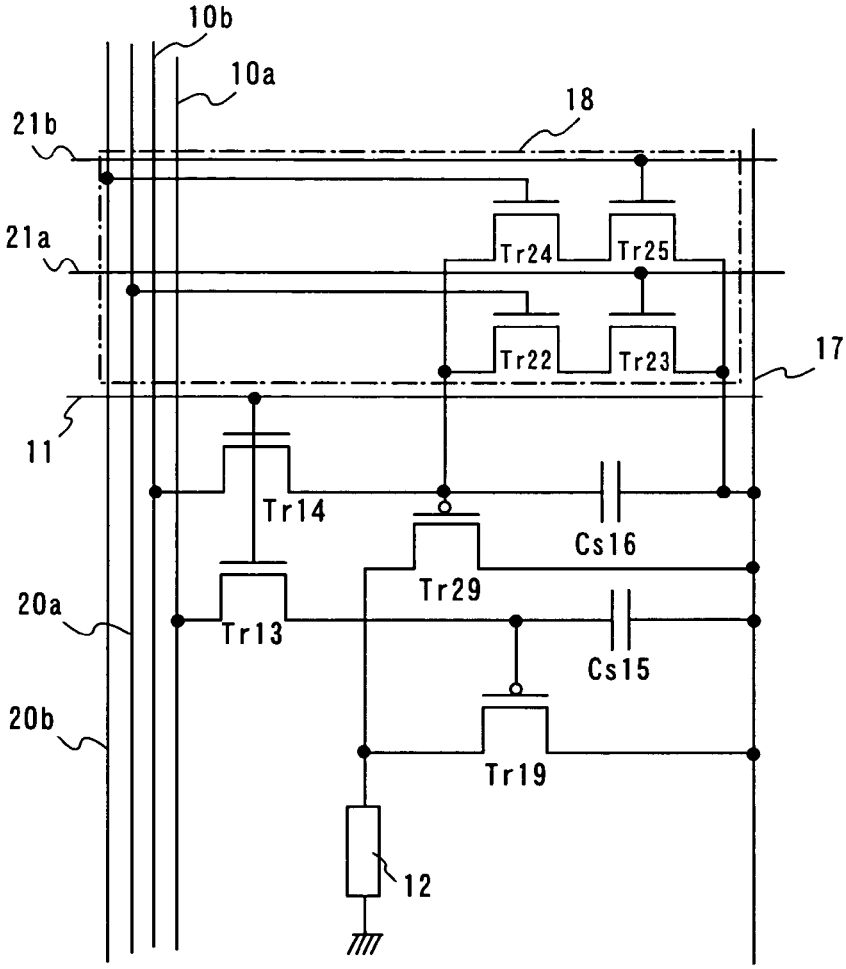
FIGS. 18A and 18B are diagrams showing pixel configurations of the display device of the invention.
Figure 18B:
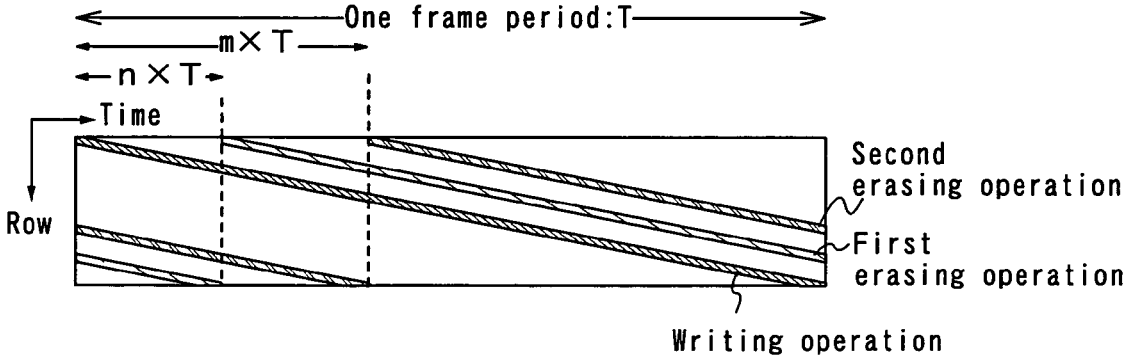

Described in this embodiment mode with reference to FIGS. 18A and 18B is the case where the lighting period control circuit is disposed at each end of the capacitor as shown in FIG. 16A and a length of a lighting period is increased further, which is different from Embodiment Mode 11.

The lighting period control circuit 18 shown in FIG. 18A includes four transistors of Tr 22, Tr 23, Tr 24 and Tr 25. Gate electrodes of the transistors Tr 22 and Tr 24 are connected to a first and second erasing signal line 20*a* and 20*b* respectively. Further, gate electrodes of the transistors Tr 23 and Tr 25 are connected to a first and second erasing scan lines 21*a* and 21*b* respectively. It should be noted that in this embodiment mode, the transistors Tr 22, Tr 23, Tr 24, and Tr 25 are n-channel transistors. Regarding the other components, descriptions are omitted because they are denoted by the same numerals in FIG. 17.

W/L of the driving transistor Tr 29 is designed to be larger than that of the driving transistor Tr 19. In this manner, a higher Vgs of driving transistors can be obtained.

In this manner, in the case where two erasing scan lines and two erasing signal lines are provided, there is a case where a lighting period of n×T and a case where a lighting period of m×T are provided, as shown in FIG. 18B. That is to say, a first erasing operation starts after n×T and a second erasing operation starts after m×T. In short, there are three lighting periods of T, n×T, and m×T.

Chart 2 shows an example of the number of gray scale levels (luminance), a lighting period (0.125, 0.25 or 1. 1 indicates that an erasing operation is not carried out), a relative proportion of video signals to the transistors Tr 29 and Tr 19, and a relative proportion of a current flowing to the light emitting element 12.

[Chart 2]

Based on a similar rule as Embodiment Mode 11. Chart 2 is different in the respect that the lighting period is shortened as (¼=0.25)T and (⅛=0.125)T.

In the case of displaying 33-level gray scale, the transistors Tr 19 and Tr 29 may be used. A video signal corresponding to 16-level gray scale is inputted to the transistor Tr 19 and a video signal corresponding to 8-level gray scale is inputted to the transistor Tr 29. Further, a lighting period is set at (⅛=0.125)T by using the lighting period control circuit 18. As a result, a current flowing to the light emitting element 12 has a value of 32+1=33.

According to the invention, a plurality of erasing operation periods can be provided according to the erasing scan line, erasing signal line, and transistors connected to each of them. Further, a timing to provide an erasing operation period, the number of an erasing operation period and like that can be determined by a practitioner appropriately.

In this embodiment mode, the lighting period control circuit 18 may be connected to the capacitor Cs 15 or two lighting period control circuits may be connected to the capacitors Cs 15 and Cs 16 respectively. By providing two lighting period control circuits, each of which can put the light emitting element into a non-emission state, a higher Vgs of a driving transistor can be obtained. As a result, an effect of a variation in Vth of the driving transistors can be considerably decreased.

An aperture ratio might be decreased in accordance with the increased number of wirings and transistors in this embodiment mode, in particular. However, by adjusting the arrangement of wirings and transistors or employing a top emission method in which a light emitting element emits light in the direction opposite to the transistors, an aperture ratio can be prevented from decreasing. The top emission method can be applied to any pixel configurations of the invention.

Embodiment Mode 13

In this embodiment mode, a specific example of a pixel configuration in which the lighting period control circuit is disposed at each end of the capacitor as shown in FIG. 16A, which is different from Embodiment Modes 11 and 12 is described.

Figure 19:
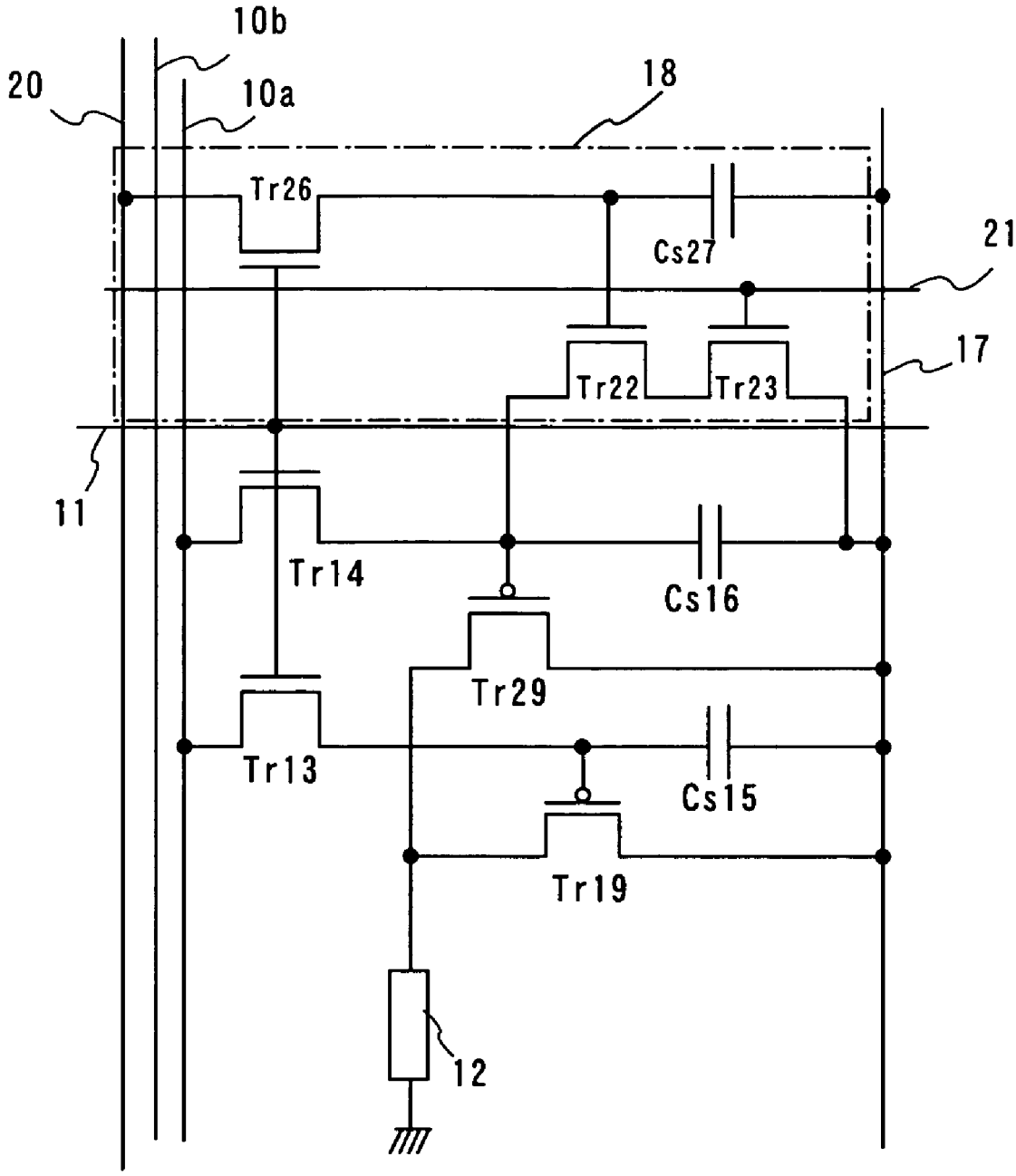
FIG. 19 is a diagram showing a pixel configuration of the display device of the invention.

As shown in FIG. 19, a pixel includes the transistor Tr 26 connected to the erasing signal line 20, the transistor Tr 22 of which gate electrode is connected to the drain electrode of the transistor Tr 26, the transistor Tr 23 which is connected to the transistor Tr 22 in series and of which gate electrode is connected to the erasing scan line 21, and the erasing capacitor Cs 27 provided between the gate electrode of the transistor Tr 22 and the power supply line 17. It should be noted in this embodiment mode that the transistors Tr 22, Tr 23 and Tr 26 are n-channel transistors. Regarding the other components, descriptions are omitted because they are denoted by the same numerals in FIG. 17.

W/L of the driving transistor Tr 29 is designed to be larger than that of the driving transistor Tr 19. In this manner, Vgs of driving transistors becomes higher and an effect of a variation in Vth of the driving transistors can be decreased.

Operation of the aforementioned pixel configuration in a low gray scale display is described now. The transistors Tr 14 and Tr 26 are selected at the same time by the scan line 11 and an analog voltage and an erasing signal are inputted from the signal line 10 and the erasing signal line 20 respectively. At this time, a charge is stored in the capacitor Cs 27 according to the inputted erasing signal and the transistor Tr 22 is turned ON. When the transistor Tr 23 is turned ON by the erasing scan line 21 after a predetermined lighting period passed, the capacitor Cs 16 releases its charge and the light emitting element 12 is put into a non-emission state. Thus, a low gray scale display is performed.

Specifically, a High signal is inputted from the erasing scan line 20 to the transistor Tr 23 in a pixel for a low gray scale display and the erasing capacitor Cs 27 keeps the transistor Tr 220N. On the other hand, a Low signal is inputted to the transistor Tr 26 in a pixel for a high gray scale display, and the erasing capacitor Cs 27 keeps the transistor Tr 22 OFF. After a predetermined period passed, the erasing scan lines are selected sequentially. When the transistors Tr 22 and Tr 23 are both turned ON, the light emitting element 12 is put into a non-emission state. That is to say, in this embodiment mode, a timing to erase the written signal is controlled by a selection of the erasing scan line in the erasing operation period.

As in Embodiment Modes 10 to 12, an analog voltage according to each gray scale is inputted from the signal line 10 to the transistor Tr 14 and a charge according to the inputted analog voltage is stored in the capacitor Cs 16, and the light emitting element 12 emits light at a desired luminance when the transistor Tr 17 is turned ON.

By using the lighting period control circuit of this embodiment mode, a timing at which an erasing signal is outputted from an erasing signal line and a timing at which an erasing scan line is selected do not have to be synchronized, therefore, a driver circuit can be controlled simply.

In this embodiment mode, the lighting period control circuit 18 may be connected to the capacitor Cs 15 or two lighting period control circuits may be connected to each of the capacitors Cs 15 and Cs 16 respectively. By providing two lighting period control circuits, each of which can put the light emitting element into a non-emission state, a higher Vgs of driving transistors can be obtained. As a result, an effect of a variation in Vth of the driving transistors can be considerably decreased.

Embodiment Mode 14

In this embodiment mode, a pixel configuration in which the lighting period control circuit 18 is arranged as shown in FIG. 16B is described with reference to FIG. 20.

Figure 20:
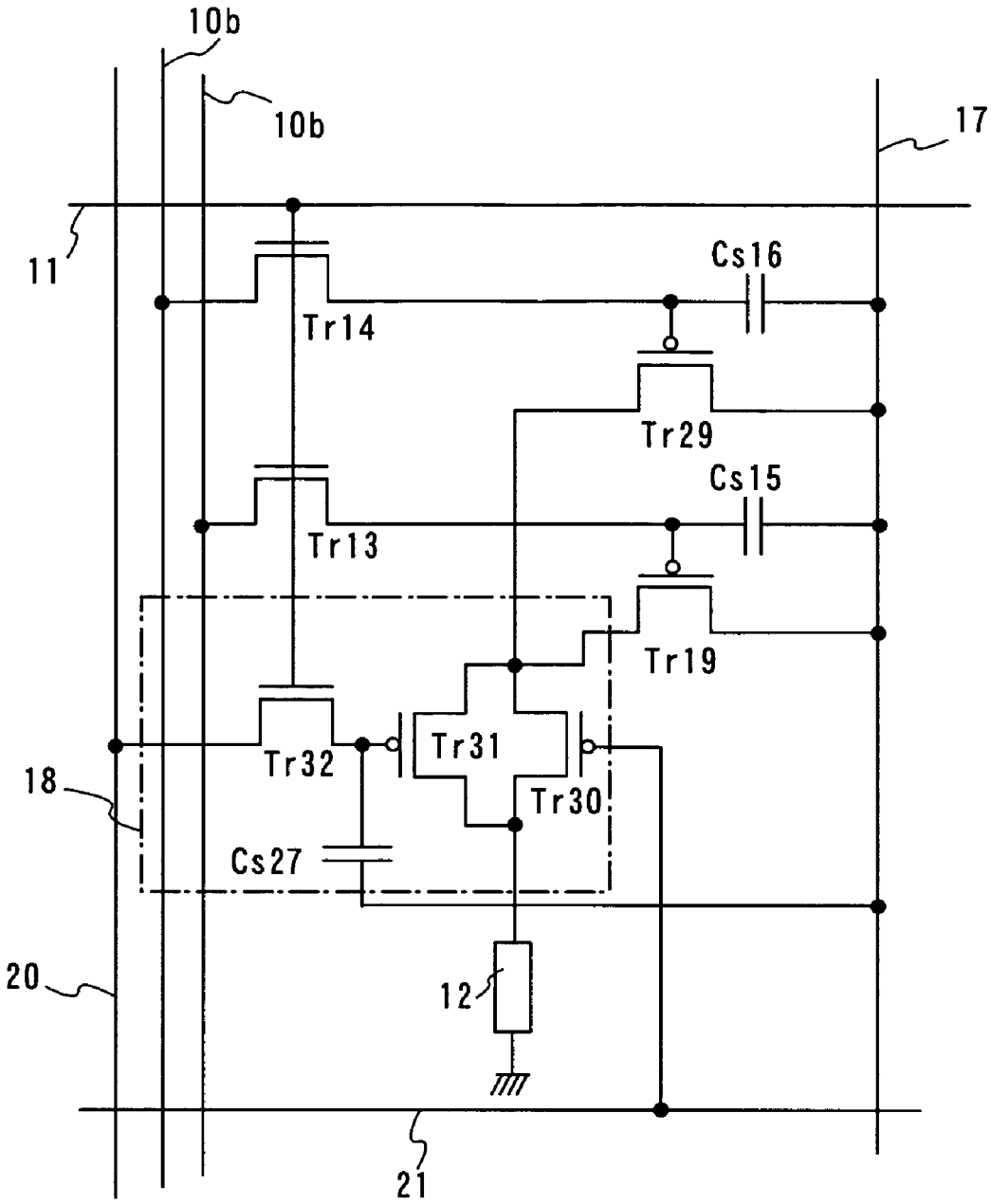
FIG. 20 is a diagram showing a pixel configuration of the display device of the invention.

A pixel shown in FIG. 20 includes the light emitting element 12 provided at an intersection of a first signal line 10*a*, the second signal line 10*b* and the scan line 11, the driving transistors Tr 19 and Tr 29 connected to the light emitting element 12 via the lighting period control circuit 18, the switching transistors Tr 13 and Tr 14 connected to the scan line 11, and to the first signal line 10*a* and the second signal line 10*b* respectively, and the capacitors Cs 15 and Cs 16 which store an analog voltage inputted via the switching transistors Tr 13 and Tr 14 and provided between each gate electrode of the transistors Tr 19 and Tr 29 and the power supply line 15. The lighting period control circuit 18 includes a transistor Tr 32, transistors Tr 30 and Tr 31 connected in parallel with each other, and the erasing capacitor Cs 27 connected to the transistor Tr 32 and the power supply line 17. The transistors Tr 32 connected to the scan line 11 and the erasing signal line 20. The transistors Tr 31 and Tr 30 connected to the transistors Tr 19 and Tr 29. The erasing capacitor Cs 27 connected to the power supply line 17. The erasing scan line 21 connected to the gate electrode of the transistor Tr 30. It should be noted in this embodiment mode that the transistors Tr 30 and Tr 31 are p-channel transistors while the transistor Tr 32 is an n-channel transistor.

W/L of the driving transistor Tr 29 is designed to be larger than that of the driving transistor Tr 19. As a result, a higher Vgs of the driving transistors can be obtained and an effect of a variation in Vth of the driving transistors can be considerably decreased.

Operation of the aforementioned pixel configuration is described now. It should be noted that an analog voltage is inputted from the signal line and the light emitting element 12 emits light at a predetermined luminance according to the charge stored in the capacitor Cs 16 as in Embodiment Modes 10 to 13.

In the case of a low gray scale display, the transistor Tr 32 is turned ON at the same time as the transistors Tr 13 and Tr 14 are turned ON when the scan line 11 is selected. An erasing signal is inputted from the erasing signal line 20 and a charge is stored in the erasing capacitor Cs 27. That is to say, a High signal is inputted as an erasing signal and a charge to turn OFF the transistor Tr 31 is stored in the capacitor Cs 27. At this time, the transistor Tr 17 is turned ON and the light emitting element 12 emits light at a predetermined luminance according to the stored charge in the capacitor Cs 16. Subsequently, the erasing scan line 21 is sequentially selected in the erasing operation period to input a High signal, and the p-channel transistor Tr 31 is turned OFF and the light emitting element 12 is thus put into a non-emission state.

In the case of a high gray scale display, a charge to turn ON the transistor Tr 31 is stored in the capacitor Cs 27. Therefore, the light emitting element 12 emits light even when the erasing scan line 21 is selected and the transistor Tr 30 is turned OFF by a High signal inputted.

In this manner, by providing the lighting period control circuit 18 between the light emitting element 12 and the driving transistor Tr 17, the light emitting element 12 emits light accurately even when the transistor Tr 17 is a normally-on transistor.

In FIG. 20, the transistors Tr 13, Tr 14, and Tr 32 are all connected to a common scan line, however, they may be connected to separate scan lines. In this case, the light emitting element 12 is put into a non-emission state when the timing at which an erasing signal is outputted from the erasing signal line 20 and the timing at which the erasing scan line 21 is selected are synchronized.

In this embodiment mode, two lighting period control circuits 18 may be provided between the transistor Tr 19 and the light emitting element 12 and between the transistor Tr 29 and the light emitting element 12 respectively. By providing two lighting period control circuits, each of which can put the light emitting element 12 into a non-emission state, a higher Vgs of driving transistors can be obtained. As a result, an effect of a variation in Vth of the driving transistors can be considerably decreased.

Embodiment Mode 15

Heretofore described is the case of a voltage input method, however, the invention can be applied to the case of a current input method as well. The current input method is a method for controlling a luminance of a light emitting element by flowing a current (also referred to as a signal current) to the light emitting element as a video signal. In the case of the current input method, a multilevel gray scale is displayed according to a value of a signal current flowing to the light emitting element. In this embodiment mode, a case where the lighting period control circuit is applied to a pixel of a current input method in which an analog current is supplied as a video signal is described.

Figure 21:
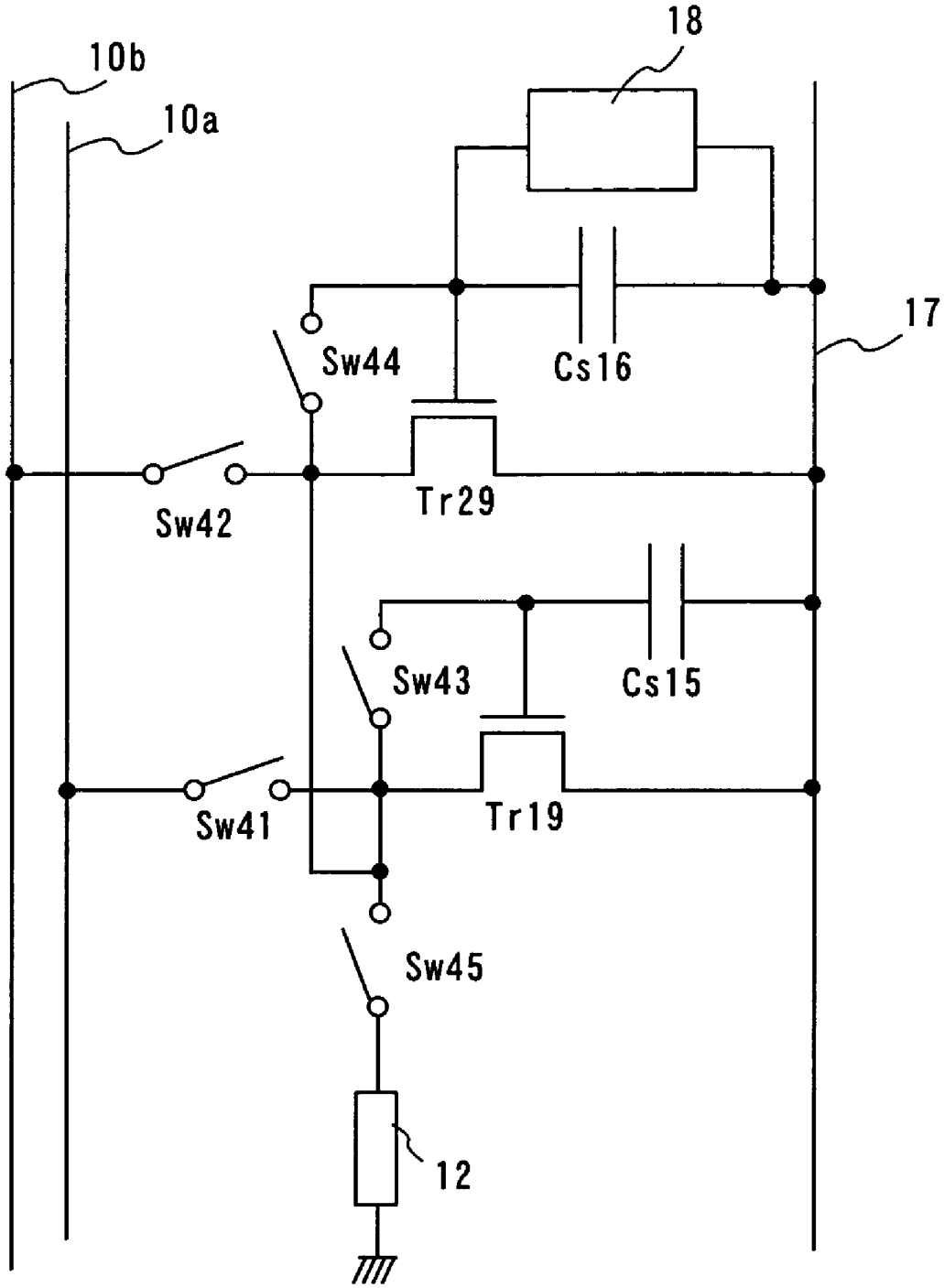
FIG. 21 is a diagram showing a pixel configuration of the display device of the invention.

FIG. 21 shows an example of a pixel of a current input method, including switches Sw 41 and Sw 42 connected to the signal line 10*a* and 10*b* respectively, the driving transistors Tr 19 and Tr 29 connected to the switches Sw 41 and Sw 42 respectively, the capacitors Cs 15 and Cs 16 provided between each gate electrode of the transistors Tr 19 and Tr 29 and the power supply line 17, the lighting period control circuit 18 provided at each end of the capacitor Cs 16, a switch Sw 45 connected to the light emitting element 12, a switch Sw 43 connected between the gate electrode of the transistor Tr 19 and the switch Sw 45, and a switch Sw 44 provided between the gate electrode of the transistor Tr 29, the capacitor Cs 16, and the lighting period control circuit 18, and the switch Sw 45.

W/L of the driving transistor Tr 29 is designed to be larger than that of the driving transistor Tr 19. As a result, a higher Vgs of the driving transistors can be obtained and an effect of a variation in Vth of the driving transistors can be considerably decreased.

In the case of a low gray scale display of such a pixel of the current input method, an extremely small current is to be inputted from the signal line. Then, an accurate current may not be supplied due to a wiring resistance of a signal line and the like. However, by providing a lighting period control circuit of the invention, a lighting period can be controlled by supplying a larger current than a predetermined current, which increases a write speed and enables an accurate low gray scale display.

In the current input method, any circuit configurations may be employed. For example, when displaying a low gray scale in the pixel configuration including a current mirror circuit, an input signal current can be made large by providing the lighting period control circuit, thus a write speed is increased.

In this manner, the lighting period control circuit can be applied to any pixels of the current input method and the lighting period control circuit may employ any configurations described in Embodiment Modes 10 to 14.

Embodiment Mode 16

In this embodiment mode, a display device as a whole including a pixel to which the lighting period control circuit shown in FIGS. 17A and 17B is applied is described.

Figure 22:
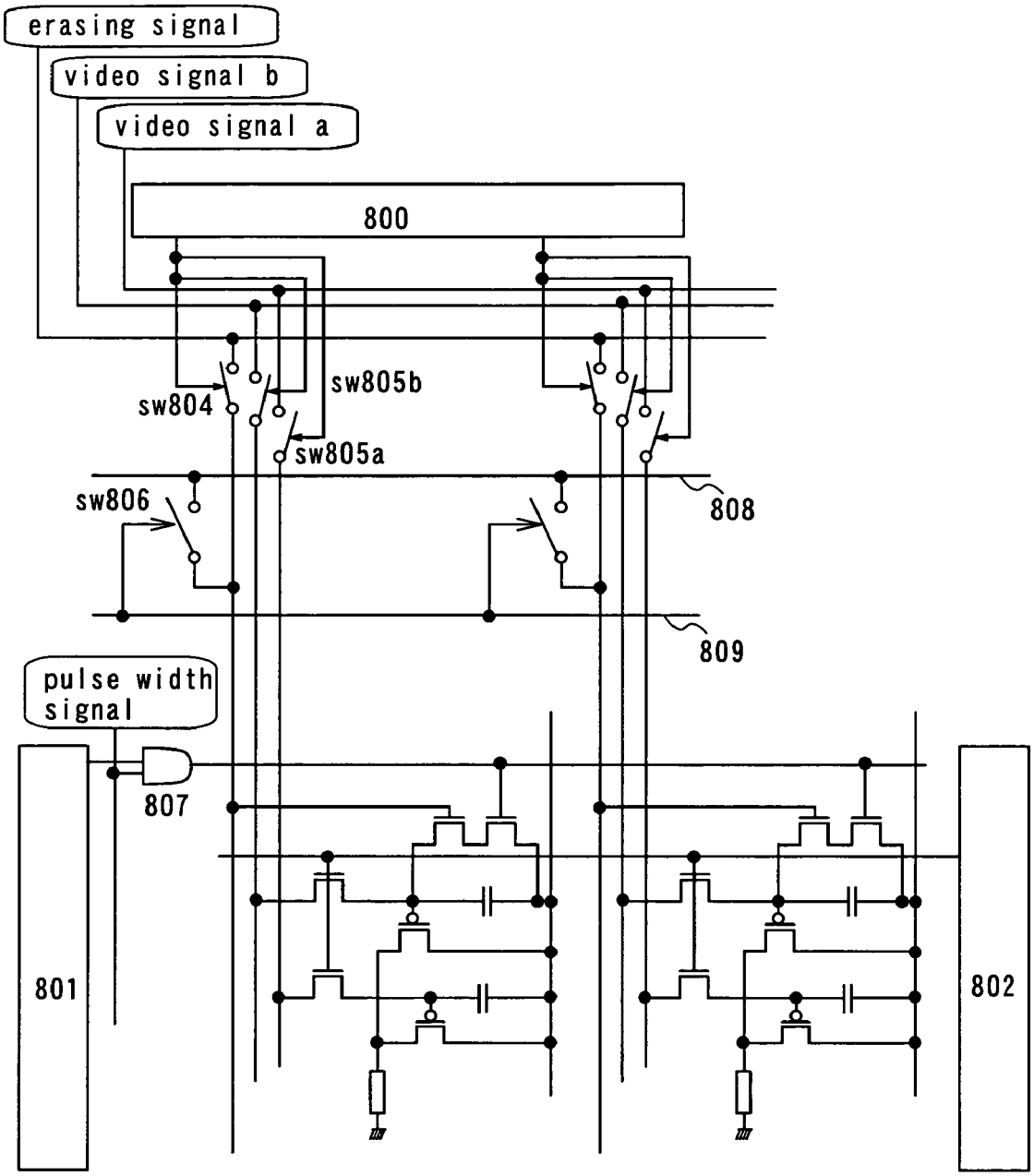
FIG. 22 is a diagram showing a display device of the invention.

FIG. 22 includes switches Sw 804, Sw 805*a*, and Sw 805*b* connected to a wiring to which an erasing signal and video signals a and b are inputted, and the shift register 800 for controlling ON/OFF of the switches Sw 804, Sw 805*a*, and Sw 805*b*. The video signal a is inputted to the first signal line 10*a* via the switch Sw 805*a* and the video signal b is inputted to the second signal line 10*b* via the switch Sw 805*b*.

FIG. 22 also includes an initialization power supply line 808, an initialization signal line 809, and a switch Sw 806 between the initialization power supply line 808 and the switch Sw 804. The selection shift register 802 includes a flip-flop circuit and the like and selects the scan line 11 sequentially. The erasing shift register 801 also includes a flip-flop circuit and the like and selects the erasing scan line 21 sequentially. Also, the AND circuit 807 to which a pulse width signal is inputted is provided between the erasing shift register 801 and the erasing scan line 21.

A reason for providing the AND circuit is described now. In the pixel configuration shown in FIGS. 17A and 17B, when the erasing scan line 21 is selected, a charge in the capacitor Cs 16 is released in the case where a signal to turn ON the transistor Tr 22 is inputted to the erasing signal line 20. That is to say, when an erasing signal of the preceding row remains in the erasing signal line 20, a charge in the capacitor Cs 16 is released and the charge does not return even when a signal to turn OFF the transistor Tr 22 is inputted to the erasing signal line 20 after the erasing scan line 21 is selected. Therefore, when selecting an erasing scan line of a certain row, potentials of the erasing signal lines of a whole row are required to be initialized once so that a charge in the capacitor Cs 16 is not released. For this reason, the AND circuit 807 is provided to which a pulse width signal is inputted. Further, the initialization power supply line 808 and an initialization signal line 809 are provided so that an initialization signal is inputted before the erasing scan line 21 is selected.

Figure 23:
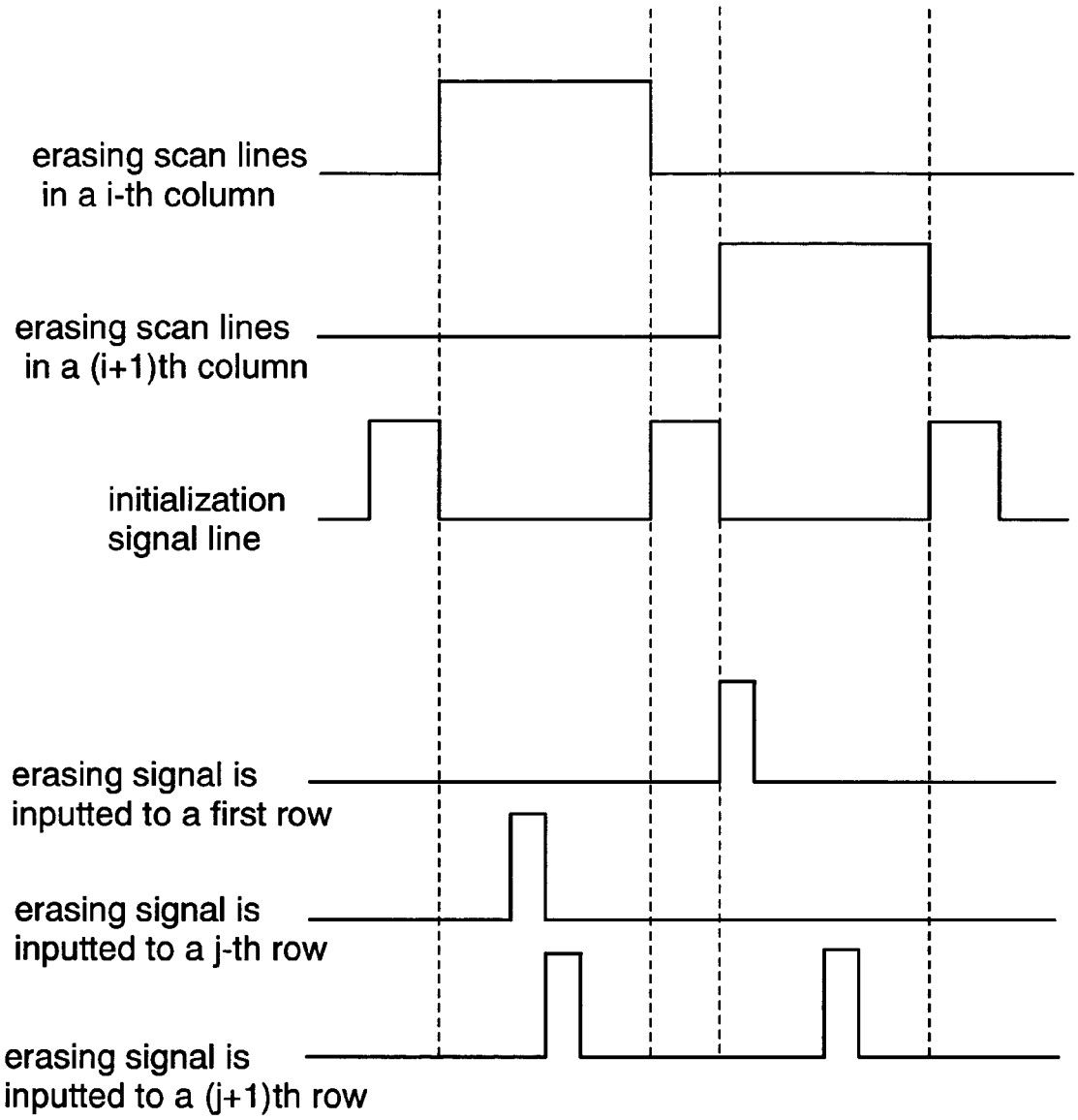
FIG. 23 is a timing chart of a display device of the invention.

A timing chart of the aforementioned operation is described now. FIG. 23 shows an example of the case where pixels in (i+1) th row and first column, i-th row and j-th column, i-th row and (j+1) th column, and (i+1) th row and (j+1) th column display low gray scales, that is the case of shortening a lighting period. First, a timing at which erasing scan lines in i-th and (i+1) th rows are selected and a timing at which an initialization signal line is selected are described. A pulse width signal is inputted to one terminal of the AND circuit 807 from the erasing shift register 801. Then, another pulse width signal is inputted to another terminal of the AND circuit 807. The AND circuit outputs a High signal only when a High signal is inputted from both terminals thereof. Therefore, a selection of the erasing scan lines is controlled so that a timing at which the initialization signal line is selected and a timing at which the erasing scan line is not selected are synchronized with a timing at which a Low signal is inputted as another pulse signal. In this manner, a High signal can be inputted from the initialization signal line before the erasing scan line in each row is selected and a period in which the erasing scan line for initializing a potential of the erasing signal line is thus not selected can be provided.

A description is made on an erasing signal to be inputted to each pixel for a low gray scale display, namely each pixel in first row, j-th row, and (j+1) th row. The erasing signal is written sequentially from the erasing signal line in the erasing operation period. A High erasing signal is inputted before a timing at which the erasing scan line of a predetermined pixel in which an erasing operation is performed is selected. That is to say, in the erasing operation period, a High erasing signal is inputted to a first row of the erasing signal line when an erasing scan line in (i+1) th row is selected, to j-th row of the erasing signal line when i-th column of erasing scan line is selected, and to (j+1) th erasing signal line when i-th column and (i+1) th column of erasing scan line are selected. The light emitting element is put into a non-emission state in synchronization with the aforementioned selection of the erasing scan line and the erasing signal from the erasing signal line.

In this manner, a light emitting element can be put into a non-emission state in each pixel to display a low gray scale.

Embodiment Mode 17

In this embodiment mode, a display device as a whole including a pixel to which the lighting period control circuit in FIG. 19 is applied is described.

Figure 24:
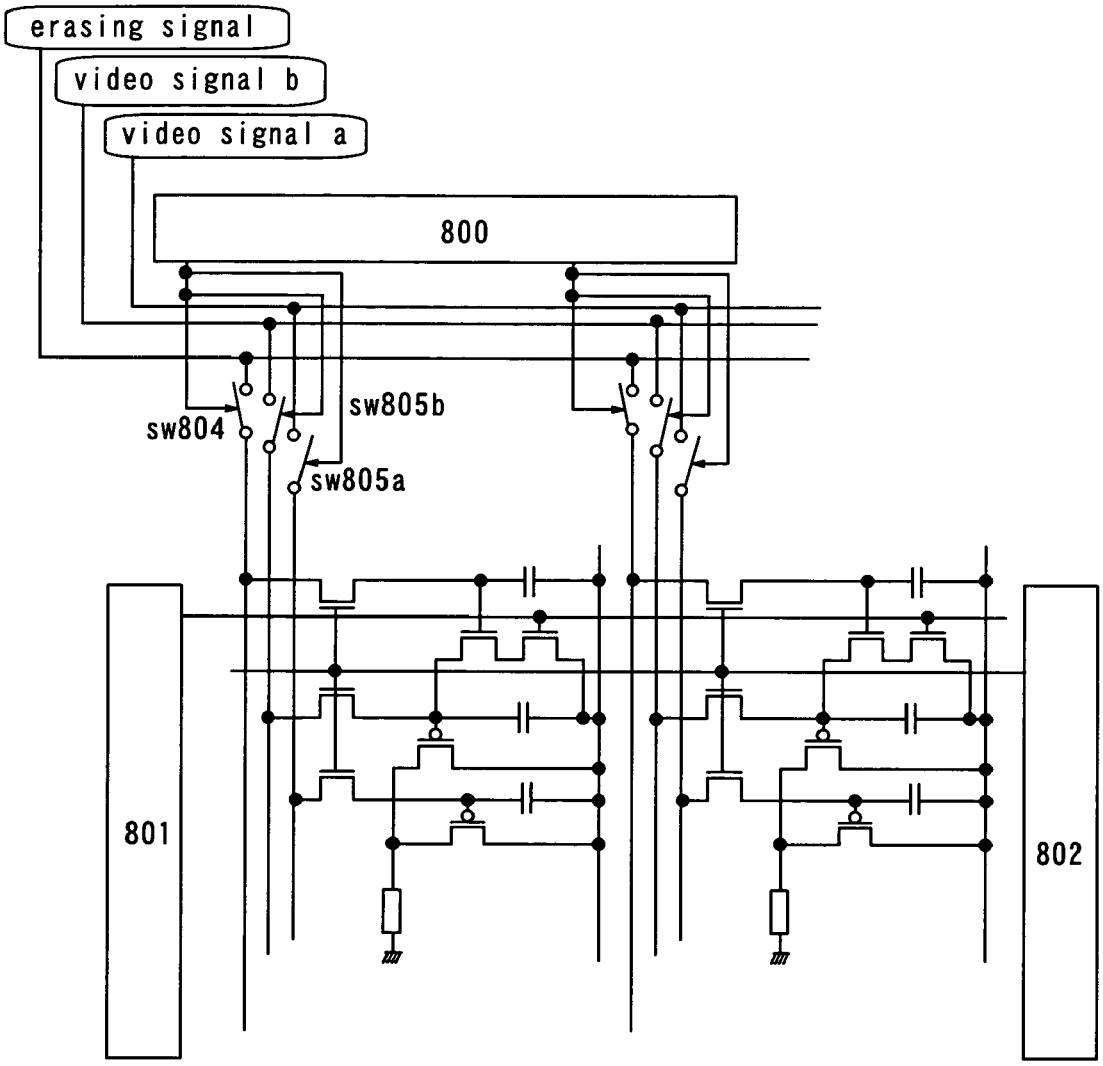
FIG. 24 is a diagram showing a display device of the invention.

FIG. 24 includes switches the Sw 804, Sw 805*a* and Sw 805*b* connected to a wiring to which an erasing signal, video signals a and b are inputted, and the shift register 800 for controlling ON/OFF of the switches Sw 804, Sw 805*a* and Sw 805*b*. The video signal a is inputted to the first signal line 10*a* via the switch Sw 805*a* and the video signal b is inputted to the second signal line 10*b* via the switch Sw 805*b*. Further, the erasing shift register 801 for controlling a selection of the erasing scan line 21 and the selection shift register 802 for controlling a selection of the scan line 11 is provided.

In the aforementioned pixel configuration, the video signals a and b and an erasing signal may be inputted. Therefore, a switch or other logic circuits do not have to be provided, which makes a structure of a display device simpler.

Embodiment Mode 18

In this embodiment mode, another effect of providing the lighting period control circuit in each pixel is described.

In displaying a multilevel gray scale by a time gray scale method in which one frame is divided into a plurality of subframes by using the digital gray scale method as described above, a pseudo contour may appear. By using a single of plurality of the lighting period control circuit of the invention, an order of the subframes are changed in each pixel to prevent the pseudo contour from appearing. For example, an order of the subframes or a time to start or terminate the subframes are changed in each row or pixel so that the emission and non-emission are performed randomly in each pixel. Thus, a visible pseudo contour is decreased by narrowing an area in which an emission and non-emission continues alternately.

Figure 25A:
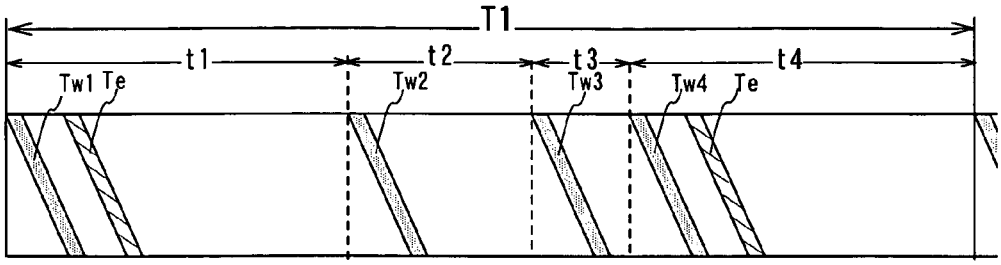
FIGS. 25A and 25B are timing charts of a display device of the invention.
Figure 25B:
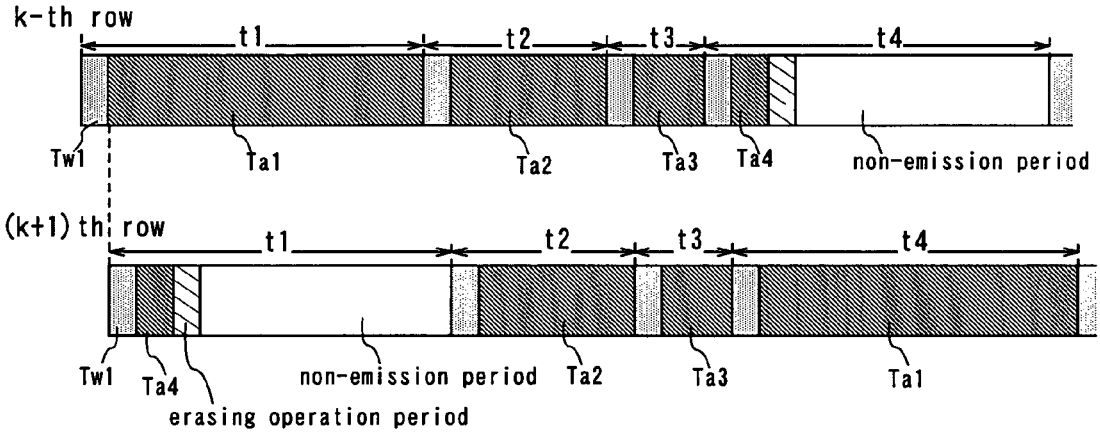

As shown in FIGS. 25A and 25B, specifically, a time to terminate the lighting period is changed in the pixels of k-th row and (k+1) th row by using the lighting period control circuit.

FIG. 25A is a timing chart of 4-bit 16-level gray scale display in which one frame denoted as T is divided into four subframes denoted as t1 to t4. As shown in FIG. 25A, periods t1 to t4 include write operation periods Tw1 to Tw4 respectively in which a signal is written from the signal line, and an erasing operation Te is provided in the periods t1 and t4.

FIG. 25B shows a state of the pixels in k-th row and (k+1) th row in the case of displaying 16-level gray scale, that is the case of displaying white by emitting light in all subframe periods. In the period t1, writing Tw1 is carried out to the pixels in k-th row, which starts a lighting period Ta1. At this time, writing Tw1 is also carried out to the pixels in (k+1) th row, and an erasing operation Te erases the written signal and a lighting period Ta4 follows. In the period t2, writing Tw2 is carried out to the pixels k-th row and a lighting period Ta2 starts. At this time in (k+1) th row, writing Tw2 is also carried out and a lighting period Ta2 starts. In the period t3, writing Tw3 is carried out to the pixels in k-th row and a lighting period Ta3 starts. At this time in (k+1) th row, writing Tw3 is also carried out and a lighting period Ta3 starts. In the period t4, writing Tw4 is carried out to the pixels in k-th row and an erasing operation Te erases the written signal and a lighting period Ta4 follows. At this time in (k+1) th row, writing Tw4 is also carried out and a lighting period Ta1 starts.

In displaying other than white, an order of lighting periods may be changed as well. Further, in displaying other than 16-level gray scale also, an order of lighting periods may be changed.

In the erasing operation period, specifically, erasing scan lines are sequentially selected. When an erasing signal is inputted from the erasing signal line, a light emitting element is put into a non-emission state. Therefore, length of lighting periods can be controlled which allows an order of lighting periods to be changed. In FIGS. 25A and 25B, a time to start the lighting period Ta4 can be changed considerably in each row.

In FIGS. 25A and 25B, two erasing operations are provided for which the lighting period control circuit as shown in FIG. 18A may be used, for example. It is needless to say that any lighting period control circuit other than the one shown in FIG. 18A may be used.

Figure 26A:
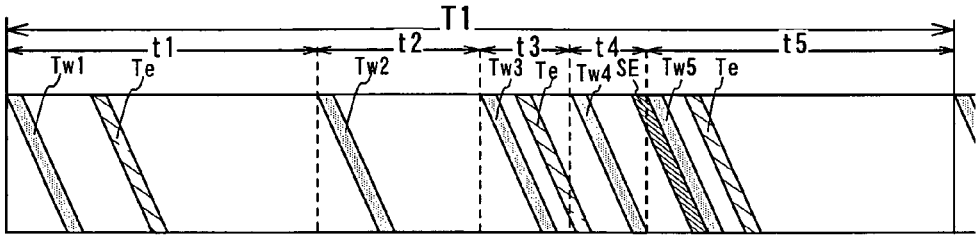
FIGS. 26A and 26B are timing charts of a display device of the invention.

FIG. 26A is a timing chart of 32-level gray scale display in which one frame denoted as T is divided into five subframes denoted as t1 to t5. Note that a erasing period SE is provided here. The erasing period SE is provided because a duty ratio is decreased when the time gray scale method is employed to display a multilevel gray scale, that is when each subframe is shortened. By providing the erasing period SE, a write operation period can be provided while putting a light emitting element in a non-emission state, thus a duty ratio can be prevented from decreasing.

In FIG. 26A, periods t1 to t5 have write operation periods Tw1 to Tw5 in which a signal is written from the signal line, and a first erasing operation period Te is provided in the periods t1, t3 and t5 and a erasing period SE is provided in the period t4.

Figure 26B:
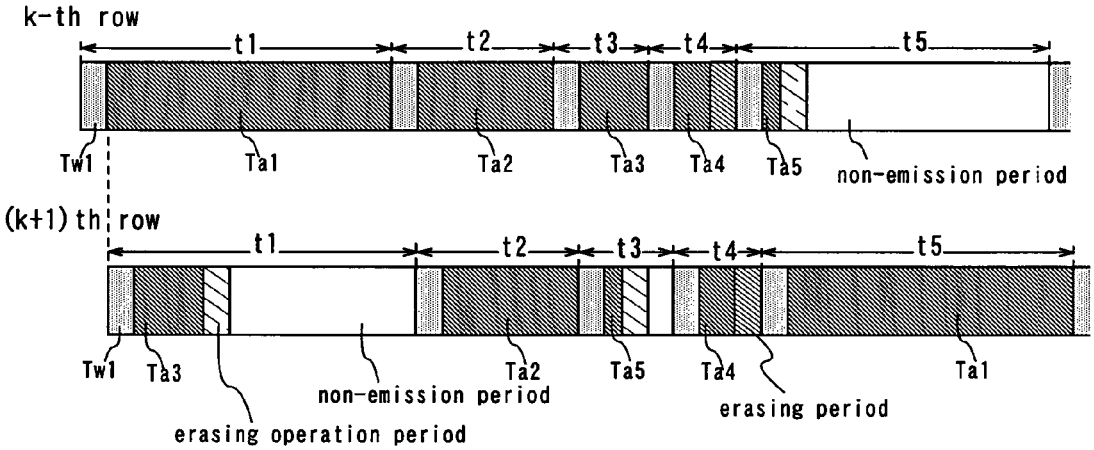
Figure 27:
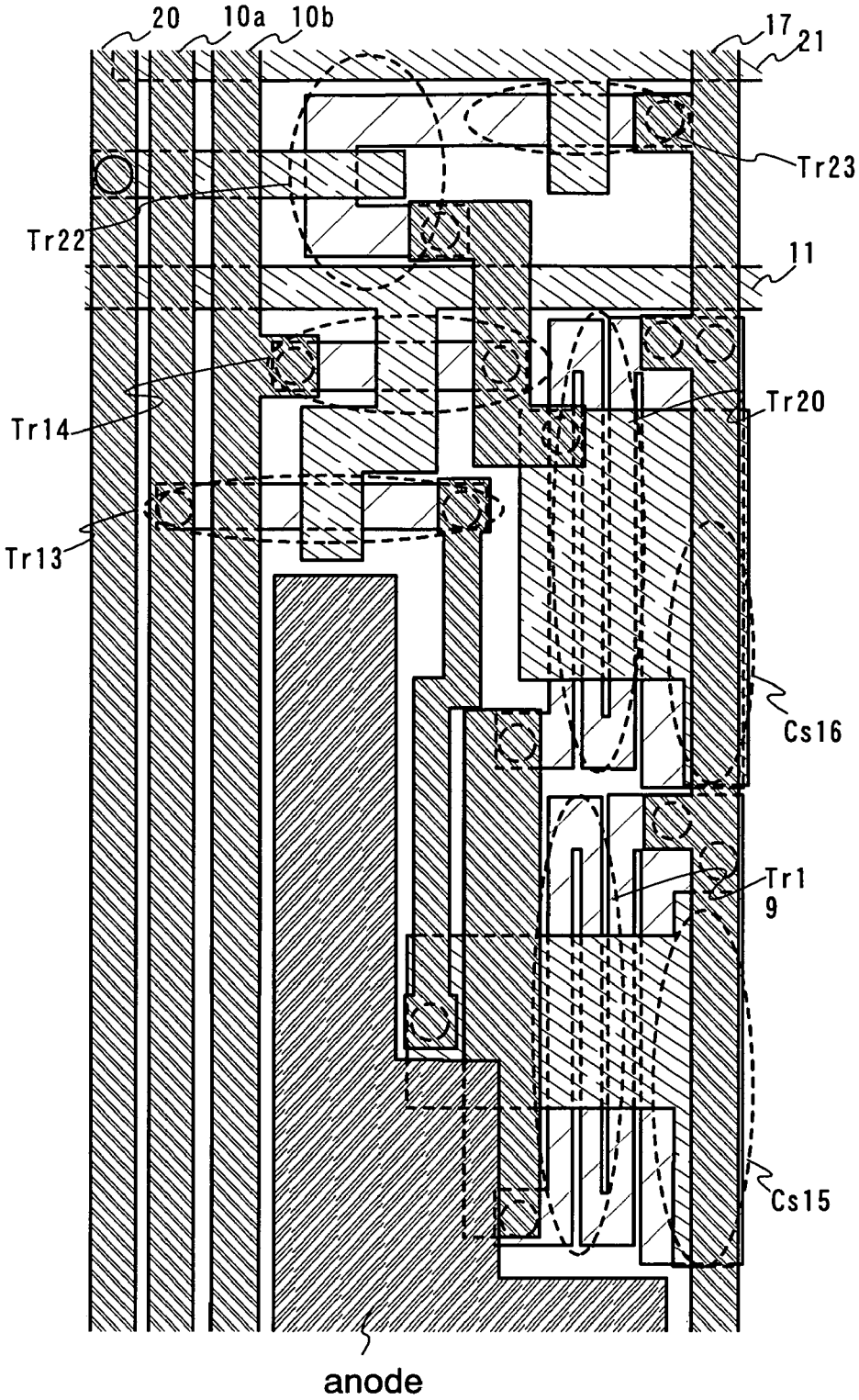
FIG. 27 is a top plan view of a pixel configuration of a display device of the invention.

FIG. 26B shows a state of k-th row and (k+1) th row in the case of displaying 32-level gray scale, that is the case of displaying white by emitting light in all subframe periods. In the period t1, writing Tw1 is carried out to the pixels in k-th row and a lighting period Ta1 starts. At this time, writing Tw1 is also carried out to the pixels in (k+1) th row, and a lighting period Ta3 and an erasing operation Te erases the written signal follows. In the period t2, writing Tw2 is carried out to the pixels in k-th row and a lighting period Ta2 starts. At this time in (k+1) th row, writing Tw2 is also carried out and a lighting period Ta2 starts. In the period t3, write Tw3 is carried out to the pixels in k-th row and a lighting period Ta3 starts. At this time in (k+1) th row, writing Tw3 is also carried out and a lighting period Ta5 starts and an erasing operation Te erases the written signal follows. In the period t4, writing Tw4 is carried out to the pixels in k-th row and a lighting period Ta4 and an erasing period SE erases the written signal follows. At this time in (k+1) th row, writing Tw4 is also carried out and a lighting period Ta4 and an erasing period SE erases the written signal starts. In the period t5, writing Tw5 is carried out to the pixels in k-th row and a lighting period Ta5, and a first erasing operation Te erases the written signal follows. At this time in (k+1) th row, writing Tw5 is also carried out and a lighting period Ta1 starts.

In displaying other than white, an order of lighting periods may be changed as well. Further, in displaying other than 32-level gray scale also, an order of lighting periods may be changed.

In the erasing operation period, specifically, erasing scan lines are sequentially selected. When an erasing signal is inputted from the erasing signal line, a light emitting element is put into a non-emission state. Therefore, length of lighting periods can be controlled which allows an order of lighting periods to be changed.

In FIGS. 26A and 26B, three first erasing operation periods are provided. For example, they may be utilized by increasing an erasing scan line, an erasing signal line, and a transistor by applying the lighting period control circuit as shown in FIGS. 18A and 18B. Further, other lighting period control circuits may be applied as well.

The order to change the subframes or the number of erasing operation periods are not limited to FIGS. 25A, 25B, 26A and 26B. Any lighting period control circuit in Embodiment Modes 10 to 14 may be used.

In this manner, by changing the order of lighting periods in each row, that is by changing the time to terminate the lighting period, a pseudo contour can be prevented from appearing. Further, it is more preferable that the order of lighting periods be changed in each row, column, and pixel. In particular, a pseudo contour may be prevented by changing the order of lighting periods in each adjacent pixel.

Embodiment Mode 19

An active matrix substrate fabricated by using the circuit of the invention can be applied to a variety of electronic devices. Such electric devices include a portable information terminal (a portable phone, a mobile computer, a portable game machine, an electronic book or the like), a video camera, a digital camera, a goggle display, a display, a navigation system and the like. Specific examples of the electronic devices are shown in FIGS. 12A to 12E.

Figure 12A:
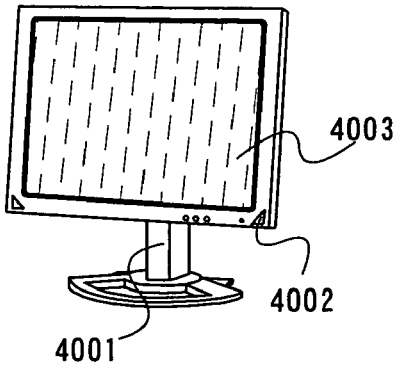
FIGS. 12A to 12E are diagrams showing electronic devices of the invention.

FIG. 12A illustrates a display including a housing 4001, an audio output portion 4002, a display portion 4003 and the like. According to the invention, the display portion 4003 including the light emitting element can be formed. The display device includes the entire display devices for displaying information, such as a personal computer, a receiver of TV broadcasting and an advertising display.

Figure 12B:
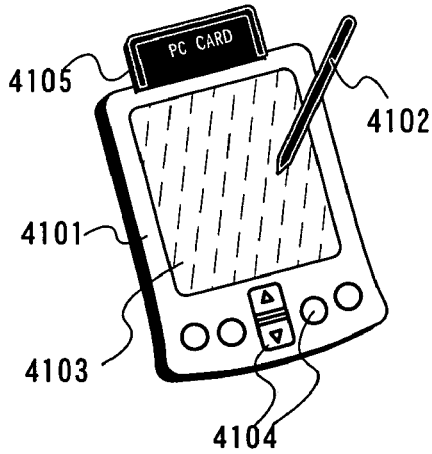

FIG. 12B illustrates a mobile computer including a body 4101, a stylus 4102, a display portion 4103, operating buttons 4104, an external interface 4105 and the like. According to the invention, the display portion 4103 including the light emitting element can be formed.

Figure 12C:
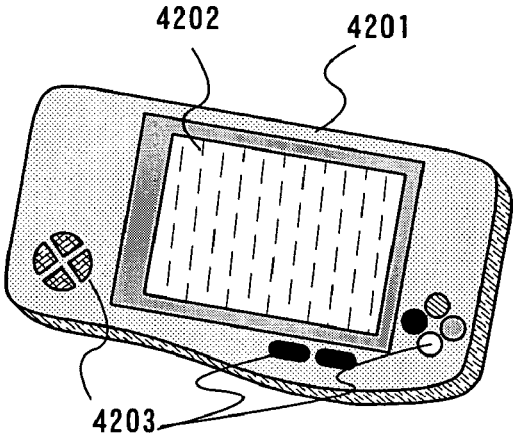

FIG. 12C illustrates a game machine including a body 4201, a display portion 4202, operating buttons 4203 and the like. According to the invention, the display portion 4202 including the light emitting element can be formed.

Figure 12D:
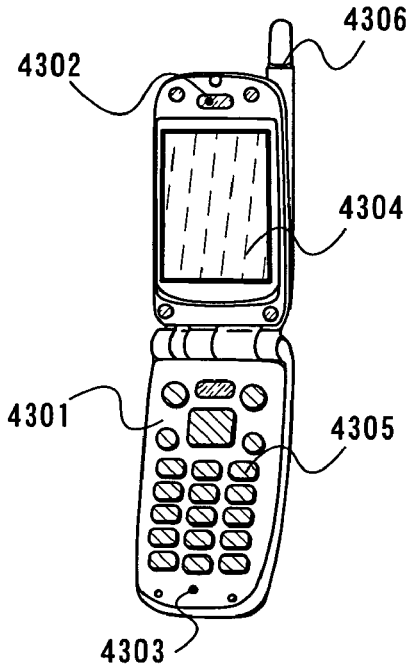

FIG. 12D illustrates a portable phone including a body 4301, an audio output portion 4302, an audio input portion 4303, a display portion 4304, an operating switch 4305, an antenna 4306 and the like. According to the invention, the display portion 4304 including the light emitting element can be formed.

Figure 12E:
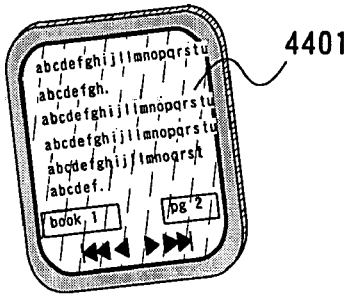

FIG. 12E illustrates an electronic book reader including a display portion 4401 and the like. According to the invention, the display portion 4401 including the light emitting element can be formed.

As described above, the invention can be applied to a wide variety of electronic devices in all fields. By using a flexible substrate as an insulating substrate of the active matrix substrate, a thinner and lighter electronic device can be formed.

This application is based on Japanese Patent Application serial no. 2003-138781 and Japanese Patent Application serial no. 2003-138796 filed in Japan Patent Office on 16th, May, 2003, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

CHART 1

| gray scale levels (luminance) | lighting period | a video signal which is inputted to the transistor Tr 29 | a video signal which is inputted to the transistor Tr 19 | a relative proportion of a current flowing to the light emitting |
|---|---|---|---|---|
| 0 | 0.25 | 0 | 0 | 0 |
| 1 | 0.25 | 4 | 0 | 1 |
| 2 | 0.25 | 8 | 0 | 2 |
| 3 | 0.25 | 12 | 0 | 3 |
| 4 | 0.25 | 16 | 0 | 4 |
| 5 | 0.25 | 20 | 0 | 5 |
| 6 | 0.25 | 24 | 0 | 6 |
| 7 | 0.25 | 28 | 0 | 7 |
| 8 | 0.25 | 32 | 0 | 8 |
| 9 | 0.25 | 36 | 0 | 9 |
| 10 | 0.25 | 40 | 0 | 10 |
| 11 | 0.25 | 44 | 0 | 11 |
| 12 | 0.25 | 48 | 0 | 12 |
| 13 | 0.25 | 52 | 0 | 13 |
| 14 | 0.25 | 56 | 0 | 14 |
| 15 | 0.25 | 60 | 0 | 15 |
| 16 | 0.25 | 64 | 0 | 16 |
| 17 | 1 | 17 | 0 | 17 |
| 18 | 1 | 18 | 0 | 18 |
| 19 | 1 | 19 | 0 | 19 |
| 20 | 1 | 20 | 0 | 20 |
| 21 | 1 | 21 | 0 | 21 |
| 22 | 1 | 22 | 0 | 22 |
| 23 | 1 | 23 | 0 | 23 |
| 24 | 1 | 24 | 0 | 24 |
| 25 | 1 | 25 | 0 | 25 |
| 26 | 1 | 26 | 0 | 26 |
| 27 | 1 | 27 | 0 | 27 |
| 28 | 1 | 28 | 0 | 28 |
| 29 | 1 | 29 | 0 | 29 |
| 30 | 1 | 30 | 0 | 30 |
| 31 | 1 | 31 | 0 | 31 |
| 32 | 0.25 | 0 | 16 | 32 |
| 33 | 0.25 | 4 | 16 | 33 |
| 34 | 0.25 | 8 | 16 | 34 |
| 35 | 0.25 | 12 | 16 | 35 |
| 36 | 0.25 | 16 | 16 | 36 |
| 37 | 0.25 | 20 | 16 | 37 |
| 38 | 0.25 | 24 | 16 | 38 |
| 39 | 0.25 | 28 | 16 | 39 |
| 40 | 0.25 | 32 | 16 | 40 |
| 41 | 0.25 | 36 | 16 | 41 |
| 42 | 0.25 | 40 | 16 | 42 |
| 43 | 0.25 | 44 | 16 | 43 |

CHART 1-continued

| gray scale levels (luminance) | lighting period | a video signal which is inputted to the transistor Tr 29 | a video signal which is inputted to the transistor Tr 19 | a relative proportion of a current flowing to the light emitting |
|---|---|---|---|---|
| 44 | 0.25 | 48 | 16 | 44 |
| 45 | 0.25 | 52 | 16 | 45 |
| 46 | 0.25 | 56 | 16 | 46 |
| 47 | 0.25 | 60 | 16 | 47 |
| 48 | 0.25 | 64 | 16 | 48 |
| 49 | 1 | 17 | 16 | 49 |
| 50 | 1 | 18 | 16 | 50 |
| 51 | 1 | 19 | 16 | 51 |
| 52 | 1 | 20 | 16 | 52 |
| 53 | 1 | 21 | 16 | 53 |
| 54 | 1 | 22 | 16 | 54 |
| 55 | 1 | 23 | 16 | 55 |
| 56 | 1 | 24 | 16 | 56 |
| 57 | 1 | 25 | 16 | 57 |
| 58 | 1 | 26 | 16 | 58 |
| 59 | 1 | 27 | 16 | 59 |
| 60 | 1 | 28 | 16 | 60 |
| 61 | 1 | 29 | 16 | 61 |
| 62 | 1 | 30 | 16 | 62 |
| 63 | 1 | 31 | 16 | 63 |

CHART 2

| gray scale levels (luminance) | lighting period | a video signal which is inputted to the transistor Tr 29 | a video signal which is inputted to the transistor Tr 19 | a relative proportion of a current flowing to the light emitting |
|---|---|---|---|---|
| 0 | 0.125 | 0 | 0 | 0 |
| 1 | 0.125 | 8 | 0 | 1 |
| 2 | 0.125 | 16 | 0 | 2 |
| 3 | 0.125 | 24 | 0 | 3 |
| 4 | 0.125 | 32 | 0 | 4 |
| 5 | 0.125 | 40 | 0 | 5 |
| 6 | 0.125 | 48 | 0 | 6 |
| 7 | 0.125 | 56 | 0 | 7 |
| 8 | 0.125 | 64 | 0 | 8 |
| 9 | 0.25 | 36 | 0 | 9 |
| 10 | 0.25 | 40 | 0 | 10 |
| 11 | 0.25 | 44 | 0 | 11 |
| 12 | 0.25 | 48 | 0 | 12 |
| 13 | 0.25 | 52 | 0 | 13 |
| 14 | 0.25 | 56 | 0 | 14 |
| 15 | 0.25 | 60 | 0 | 15 |
| 16 | 0.25 | 64 | 0 | 16 |
| 17 | 1 | 17 | 0 | 17 |
| 18 | 1 | 18 | 0 | 18 |
| 19 | 1 | 19 | 0 | 19 |
| 20 | 1 | 20 | 0 | 20 |
| 21 | 1 | 21 | 0 | 21 |
| 22 | 1 | 22 | 0 | 22 |
| 23 | 1 | 23 | 0 | 23 |
| 24 | 1 | 24 | 0 | 24 |
| 25 | 1 | 25 | 0 | 25 |
| 26 | 1 | 26 | 0 | 26 |
| 27 | 1 | 27 | 0 | 27 |
| 28 | 1 | 28 | 0 | 28 |
| 29 | 1 | 29 | 0 | 29 |
| 30 | 1 | 30 | 0 | 30 |
| 31 | 1 | 31 | 0 | 31 |

| gray scale levels (luminance) | lighting period | a video signal which is inputted to the transistor Tr 29 | a video signal which is inputted to the transistor Tr 19 | proportion of a current flowing to the light emitting element |
|---|---|---|---|---|
| 32 | 0.125 | 0 | 16 | 32 |
| 33 | 0.125 | 8 | 16 | 33 |
| 34 | 0.125 | 16 | 16 | 34 |

CHART 2-continued

| | | | | |
|---|---|---|---|---|
| 35 | 0.125 | 24 | 16 | 35 |
| 36 | 0.125 | 32 | 16 | 36 |
| 37 | 0.125 | 40 | 16 | 37 |
| 38 | 0.125 | 48 | 16 | 38 |
| 39 | 0.125 | 56 | 16 | 39 |
| 40 | 0.125 | 64 | 16 | 40 |
| 41 | 0.25 | 36 | 16 | 41 |
| 42 | 0.25 | 40 | 16 | 42 |
| 43 | 0.25 | 44 | 16 | 43 |
| 44 | 0.25 | 48 | 16 | 44 |
| 45 | 0.25 | 52 | 16 | 45 |
| 46 | 0.25 | 56 | 16 | 46 |
| 47 | 0.25 | 60 | 16 | 47 |
| 48 | 0.25 | 64 | 16 | 48 |
| 49 | 1 | 17 | 16 | 49 |
| 50 | 1 | 18 | 16 | 50 |
| 51 | 1 | 19 | 16 | 51 |
| 52 | 1 | 20 | 16 | 52 |
| 53 | 1 | 21 | 16 | 53 |
| 54 | 1 | 22 | 16 | 54 |
| 55 | 1 | 23 | 16 | 55 |
| 56 | 1 | 24 | 16 | 56 |
| 57 | 1 | 25 | 16 | 57 |
| 58 | 1 | 26 | 16 | 58 |
| 59 | 1 | 27 | 16 | 59 |
| 60 | 1 | 28 | 16 | 60 |
| 61 | 1 | 29 | 16 | 61 |
| 62 | 1 | 30 | 16 | 62 |
| 63 | 1 | 31 | 16 | 63 |

What is claimed is:

1. A display device comprising:

a first line to which an analog signal is inputted;

a second line;

a capacitor comprising first and second electrodes;

a light emitting element;

a first transistor electrically connected to the first line and the second line;

a second transistor comprising a gate electrically connected to one of the first and second electrodes of the capacitor and one of source and drain electrically connected to the light emitting element; and a third transistor comprising a gate electrically connected to a third line and one of source and drain directly connected to one of the first and second electrodes of the capacitor;

a fourth transistor comprising a gate electrically connected to a fourth line, one of source and drain electrically connected to the other one of the first and second electrodes of the capacitor;

a first shift register for controlling a selection of the first line and the third line;

a second shift register for controlling a selection of the fourth line; and a third shift register for controlling a selection of the second line, wherein the other one of the source and the drain of the third transistor is connected to the other one of the first and second electrodes of the capacitor through only the source and the drain of the fourth transistor.

2. The display device according to claim 1, wherein an AND circuit is connected between the fourth line and the second shift register.

3. The display device according to claim 1, wherein at least the second transistor is a thin film transistor comprising a crystalline semiconductor film.

4. A display device comprising:

a pixel, the pixel comprising:

a first transistor electrically connected to a first line and a second line;

a capacitor comprising first and second electrodes;

a light emitting element;

a second transistor comprising a gate electrically connected to one of the first and second electrodes of the capacitor, and one of source and drain electrically connected to the light emitting element;

a third transistor comprising a gate electrically connected to a third line, a source and a drain, wherein one of the source and the drain of the third transistor is directly connected to one of the first and second electrodes of the capacitor; and a fourth transistor comprising a gate electrically connected to a fourth line, a source and a drain, wherein one of the source and the drain is electrically connected to the other one of the first and second electrodes of the capacitor, wherein the other one of the source and the drain of the third transistor is connected to the other one of the first and second electrodes of the capacitor through only the source and the drain of the fourth transistor.

5. A display device according to claim 4, wherein the display device is applied to an electric device selected from the group consisting of a display, a mobile computer, a game machine, a portable phone, and an electronic book reader.

6. A display device according to claim 1, wherein the display device is applied to an electric device selected from the group consisting of a display, a mobile computer, a game machine, a portable phone, and an electronic book reader.

7. A display device comprising:

a pixel, the pixel comprising:

a first transistor electrically connected to a first line and a second line;

a capacitor comprising first and second electrodes;

a light emitting element;

a second transistor comprising a gate electrically connected to one of the first and second electrodes of the capacitor, and one of source and drain electrically connected to the light emitting element;

a third transistor comprising a gate electrically connected to a third line, a source and a drain, wherein one of the source and the drain of the third transistor is directly connected to one of the first and second electrodes of the capacitor; and a fourth transistor comprising a gate electrically connected to a fourth line, a source and a drain, wherein one of the source and the drain is electrically connected to the other one of the first and second electrodes of the capacitor, wherein the other one of the source and the drain of the third transistor is directly connected to the other one of the source and the drain of the fourth transistor.

8. A display device according to claim 7, wherein the display device is applied to an electric device selected from the group consisting of a display, a mobile computer, a game machine, a portable phone, and an electronic book reader.

* * * * *